US005718313A

United States Patent [19]

Sekine

[11] Patent Number: 5,718,313

[45] Date of Patent: Feb. 17, 1998

[54] CLUTCH MECHANISM

[75] Inventor: Noriaki Sekine, Yashio, Japan

[73] Assignee: Ricoh Company, Ltd., Tokyo, Japan

[21] Appl. No.: 659,822

[22] Filed: Jun. 7, 1996

[30] Foreign Application Priority Data

Jun. 9, 1995 [JP] Japan ..... 7-143209

[51] Int. Cl.[6] ..... B65H 3/06

[52] U.S. Cl. ..... 192/24; 192/26; 192/33 R; 192/33 C; 271/8.1

[58] Field of Search ..... 192/24, 26, 33 R, 192/33 C, 48.3, 48.92; 271/8.1

[56] References Cited

U.S. PATENT DOCUMENTS

| | | | |
|---|---|---|---|
| 1,314,260 | 8/1919 | Gindrat | 192/24 |
| 3,729,077 | 4/1973 | Torigai | 192/26 X |
| 4,193,483 | 3/1980 | Ariga et al. | 192/33 C |
| 4,682,769 | 7/1987 | Murakami et al. | 192/48.3 X |
| 4,891,665 | 1/1990 | Mizutani | 192/48.92 X |

*Primary Examiner*—Rodney H. Bonck
*Attorney, Agent, or Firm*—Oblon, Spivak, McClelalland, Maier & Neustadt, P.C.

[57] ABSTRACT

A clutch mechanism for selectively setting up or interrupting the delivery of a drive force in accordance with a direction and an amount of rotation of a shaft is disclosed. The mechanism includes a clutch gear rotated by the rotation of a motor. A slide cam is supported by a clutch shaft in such a manner as to be unrotatable relative to the shaft. Ratchet portions respectively provided on the clutch gear and slide cam are selectively coupled or uncoupled in accordance with the direction of rotation, thereby setting up or interrupting drive transmission. A cam portion is formed integrally with the slide cam and releases the ratchet portions when a pin is brought to a preselected position on a cam surface. A cam lever selectively moves the pin toward or away from the cam surface in accordance with the direction of rotation of the clutch gear. The drive source can be shared by a driveline for rotating a shaft to a preselected angular position and other drivelines.

14 Claims, 25 Drawing Sheets

FORWARD ROTATION

REVERSE ROTATION

CLUTCH MECHANISM

BACKGROUND OF THE INVENTION

The present invention relates to a clutch mechanism and, more particularly, to a clutch mechanism for selectively setting up or interrupting the transmission of a drive force for rotating a shaft in accordance with a direction and an amount of rotation of the shaft.

A clutch mechanism for the above application has customarily been installed in, e.g., an automatic paper feeder including a pick-up roller having a semicircular cross-section. In the paper feeder, the clutch mechanism selectively drives or stops the pick-up roller by delivering a drive force thereto or interrupting it. The clutch mechanism may be implemented as a solenoid-operated or electromagnetic clutch based on an electromagnetic force (referred to as a first type of conventional clutch mechanism hereinafter). The first type of conventional clutch mechanism sets up or interrupts the drive transmission to the pick-up roller by being turned on or turned off by an electric signal output from an apparatus body.

Alternatively, the clutch mechanism may use a spring clutch (referred to as a second type of conventional clutch mechanism hereinafter), as taught in Japanese Patent Laid-Open Publication Nos. 3-284547 and 3-284548. The second type of conventional clutch mechanism has a spring anchored to the pick-up roller and a control ring. The control ring is inserted in a drum portion included in a pick-up gear to thereby connect the pick-up gear and pick-up roller. The drum portion of the pick-up gear is selectively fastened or unfastened in accordance with the direction of rotation of the drive source, so that the drive transmission to the pick-up roller is selectively set up or interrupted.

However, the first type of clutch mechanism needs a complicated mechanism for rotating the pick-up roller to a reference angular position where it does not contact a stack of papers. Moreover, this type of clutch mechanism using an electromagnetic force requires a number of parts and is therefore expensive and bulky.

The second type of clutch mechanism includes a lever for stopping the pick-up roller at the reference position in engagement with a groove formed in the control ring. This kind of scheme, however, lowers reliability because the lever rotates in the radial direction of the control ring and acts in the thrust direction when releasing the pick-up roller.

Japanese Patent Application No. 4-330340 proposes a clutch mechanism capable of solving the problems particular to the first and second types of clutch mechanisms. However, because this clutch mechanism is assigned to the pick-up roller, it is not adaptive to the continuous reverse rotation of a motor. Specifically, if the motor is continuously reversed, then the driveline is caused to lock and damaged thereby. Therefore, the motor cannot be reversed by more than a certain amount, i.e., it cannot reversibly drive other rollers. The clutch mechanism, like the second type of clutch mechanism, uses a so-called spring clutch. This brings about another problem that the inside diameter of the spring clutch and the outside diameter of the drum portion of the gear are severely restricted as to tolerance. This increases the number of production steps and production cost.

SUMMARY OF THE INVENTION

It is therefore an object of the present invention to provide a clutch mechanism which allows a single drive source to be shared by a driveline for rotating a rotary shaft to a preselected angular position in a preselected direction and other drivelines to thereby reduce the cost, does not need a complicated construction, and has a simple, reliable and inexpensive configuration including a minimum number of parts.

It is another object of the present invention to further simplify the construction so as to further reduce the cost.

It is another object of the present invention to allow the above drivelines to share a single drive source with a simple construction not relying on a spring clutch, thereby further enhancing reliable operation.

It is another object of the present invention to surely stop the rotation of a rotary shaft in a preselected angular position, thereby further enhancing reliable operation.

It is another object of the present invention to provide a reliable, simple and inexpensive clutch mechanism by implementing one rotation of a rotary shaft in a preselected direction and the stop of the rotation at a preselected angular position with a simple arrangement.

It is another object of the present invention to allow the different drivelines to share a single drive source and realize drive transmission free from wasteful idle torque, thereby reducing the cost.

It is another object of the present invention to enhance the reliable operation of a clutch mechanism by surely setting up and interrupting drive transmission when it is mounted on an automatic paper feeder.

It is still another object of the present invention to restore a clutch mechanism to its stand-by state with a minimum number of parts when it is mounted on an automatic paper feeder, thereby reducing the cost.

It is yet another object of the present invention to enhance the reliable operation of a clutch mechanism when it is mounted on an automatic paper feeder by freeing it from displacement from its stand-by position.

It is a further object of the present invention to reduce the cost of a clutch mechanism when it is mounted on an automatic paper feeder by obviating wasteful load torque.

In accordance with the present invention, a clutch mechanism for rotating a rotary shaft by transmitting a drive force output from a drive source to the rotary shaft has a transmission gear rotatable on receiving the drive force. A rotary member is mounted on the rotary shaft and unrotatable relative to the rotary shaft. A coupling/uncoupling device selectively connects or disconnects the transmission gear from a stationary member in accordance with the direction of rotation of the transmission gear to thereby set up or interrupt the delivery of the drive force to the rotary member. A cancelling device is provided with a cam surface having a preselected configuration and with which the slide member slidingly contacts. The cancelling device cancels, when the slide surface rotating in accordance with the rotation of said rotary member reaches a predetermined position on the cam surface, the connection between the transmission gear and the rotary member. A moving device selectively moves the slide member in the forward or reverse direction in accordance with the direction of rotation of the transmission gear to thereby move the slide member toward or away from the cam surface of the cancelling device.

Also, in accordance with the present invention, a clutch mechanism for rotating a rotary shaft by transmitting a drive force output from a drive source to the rotary shaft has a notched gear supported by the rotary shaft, and unrotatable relative to the rotary shaft, and meshing with an intermediate gear driven by the drive source. The part of the tooth surface of the notched gear corresponding to the intermediate gear when the rotary shaft is located at a preselected reference position is removed. A torque applying device for applying a torque in the forward direction to the notched gear. A limiting/cancelling device receives the drive force of the drive source via a torque limiter. The limiting/cancelling device limits, when the rotary shaft is located at the reference position, the rotation of the notched gear against the torque applied by the torque applying device, or cancels the limitation in accordance with the drive direction of the drive source.

BRIEF DESCRIPTION OF THE DRAWINGS

The above and other objects, features and advantages of the present invention will become apparent from the following detailed description taken with the accompanying drawings in which.

DESCRIPTION OF THE PREFERRED EMBODIMENTS

Figure 1:
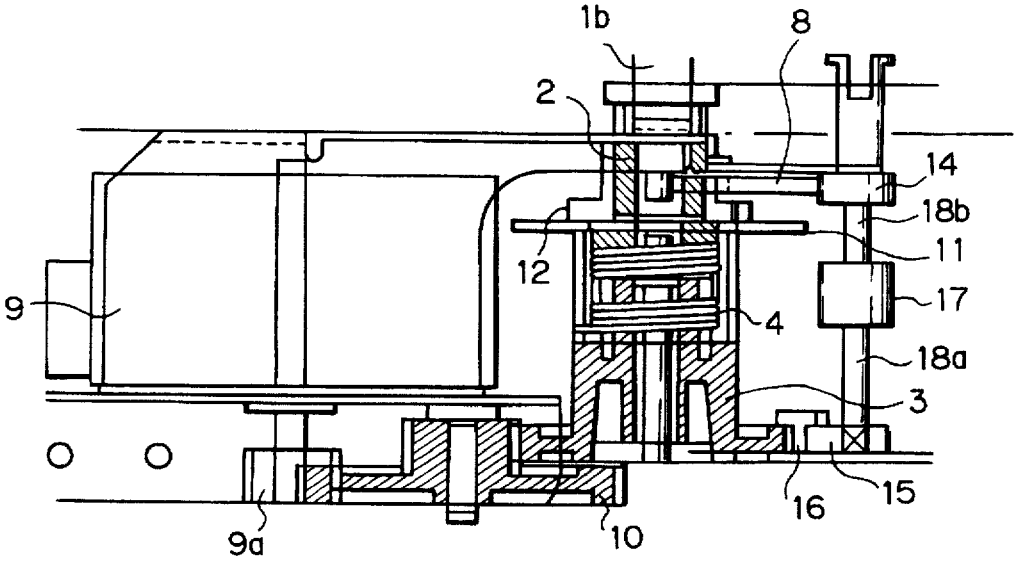
FIG. 1 is a partly sectional enlarged view showing a first embodiment of the clutch mechanism in accordance with the present invention.

To better understand the present invention, a brief reference will be made to the conventional clutch mechanism disclosed in previously mentioned Japanese Patent Application No. 4-330340 and constructed to solve the problems of the first and second types of conventional clutch mechanisms.

As shown in FIGS. 30, 31, 32A and 32B, the clutch mechanism has a clutch drum output portion 2 connected to a roller shaft 1*b*. A pick-up roller 1 has a semicircular roller portion 1*a* mounted on the roller shaft 1*b*. A spring clutch 4 is inserted in the drum portion 2*a* of the clutch drum output portion 2 at one end 4*a* and inserted in the drum portion 3*a* of a gear 3 at the other end 4*b*. The end 4*a* of the spring clutch 4 is fixedly received in a notch 2*b* formed in the clutch drum output portion 2. The output portion 2 and the other end 4*b* of the spring clutch 4 are received in a control cam 5. The other end 4*b* of the spring clutch 4 is fixedly received in a notch 5*b* formed in the control cam 5. A spiral cam groove 6 is formed in the control cam 5 in the direction of rotation of the cam 5. A rotatable cam lever 8 is received in the cam groove 6 and constantly biased by a torsion spring 7 in the radial direction of the control cam 5.

Figure 32A:
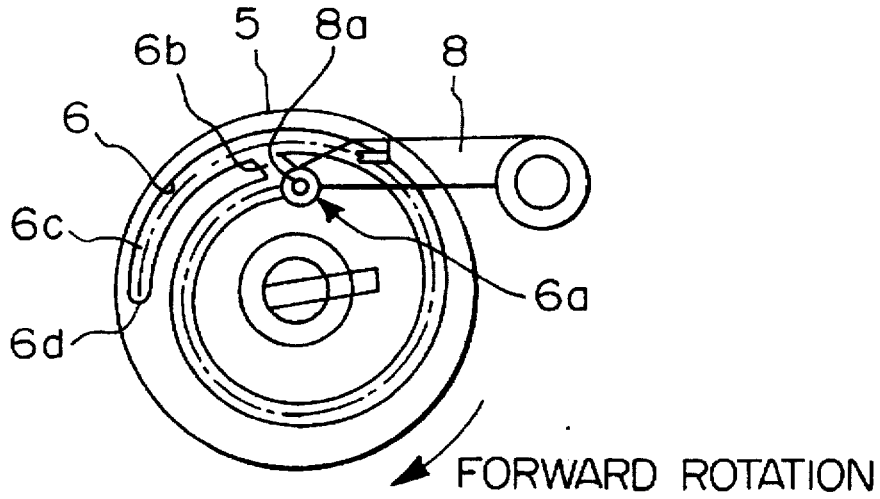
Fig. 32A PRIOR ART
FIGS. 32A and 32B are fragmentary views of the conventional clutch mechanism.
Figure 32B:
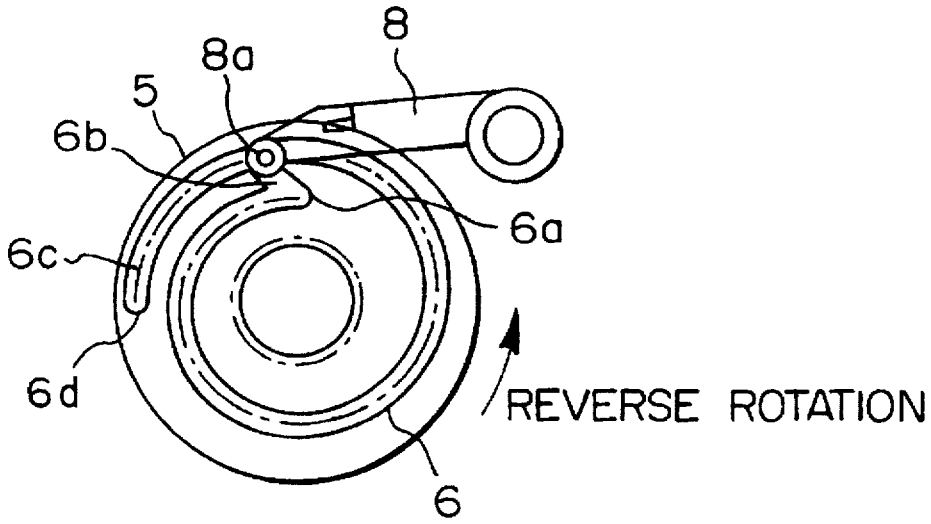
Fig. 32B PRIOR ART

As shown in FIGS. 32A and 32B, the forward direction in which the gear 3 rotates is the direction in which the spring clutch 4 fastens the drum portion 3*a* of the gear 3. When the control cam 5 is rotated to a preselected position, a pin 8*a* studded on the cam lever 8 abuts against a contact portion 6*a* included in the cam groove 6. As a result, the spring clutch 4 unfastens the drum portion 3*a* and thereby interrupts torque transmission via the gear 3, so that the roller portion 1*a* is brought to a stop at its reference angular position. When a motor 9 is reversed by several pulses, the pin 8*a* of the cam lever 8 is released from the contact portion to a peripheral release portion 6*c* via a communicating portion 6*b*. This allows the gear 3 to resume its forward rotation.

One end portion of the roller shaft 1*b* is removed in a D-shaped section. The clutch drum output portion 2 is unrotatably mounted on such a removed portion of the roller shaft 1*b*. A pinion gear 9*a* is mounted on the output shaft of the motor 9. A speed reduction gear 3 is held in mesh with the gear 3 and pinion gear 9*a* in order to transmit the output torque of the motor 9 to the gear 3.

However, because the above clutch mechanism is assigned to a pick-up roller, it is not adaptive to the continuous reverse rotation of the motor 9, as stated earlier. Specifically, if the motor 9 is continuously rotated in the reverse direction, then the control cam 5 is rotated in the reverse direction due to the contact load between the gear 3 and the drum 3*a*. As a result, the pin 8*a* of the cam lever 8*a* abuts against the end 6*d* of the release portion 6*c* and causes the spring clutch 4 to fasten the drum portion 3*a* of the gear 3. This causes the driveline to lock and thereby damages it.

In the above condition, the motor 9 cannot be reversed by more than a certain amount, i.e., it cannot drive other rollers. Another problem with the conventional mechanism is that the inside diameter of the spring clutch 4 and the outside diameter of the drum portion 3*a* of the gear 3 are severely restricted as to tolerance. This increases the number of production steps and production cost.

Preferred embodiments of the clutch mechanism in accordance with the present invention will be described hereinafter.

1st Embodiment

Figure 2A:
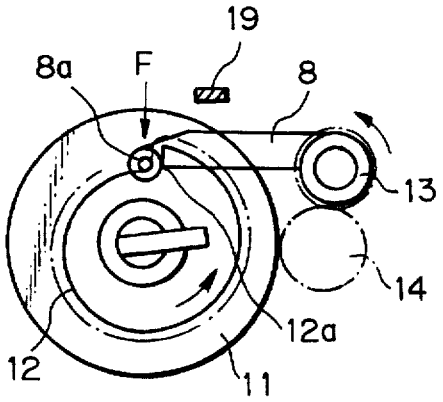
FIG. 2A is a fragmentary front view showing the first embodiment in forward rotation.
Figure 2B:
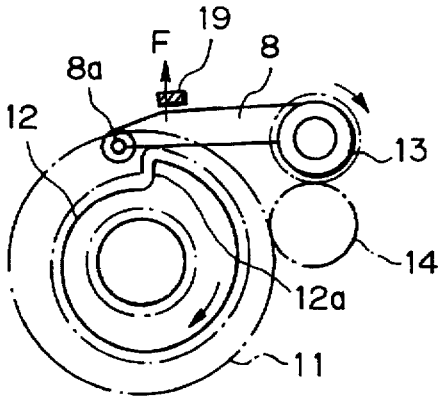
FIG. 2B is a view similar to FIG. 2A, showing the embodiment in reverse rotation.

Referring to FIGS. 1, 2A and 2B, a clutch mechanism embodying the present invention is shown and applied to an automatic paper feeder by way of example. In FIGS. 1, 2A and 2B, the same or similar constituents as or to the constituents shown in FIGS. 30, 31, 32A and 32B are designated by the same reference numerals, and a detailed description thereof will not be made in order to avoid redundancy. Because the automatic paper feeder is conventional, the following description will concentrate only on the characteristic arrangements thereof.

As shown, a clutch drum output portion 2 and a spring clutch 4 are inserted in a control cam 11. The other end 4*b* of the spring clutch 4 is fixedly received in a notch 5*b*. A spiral cam surface 12 is formed on one end of the control cam 11 in parallel to the axis of the cam 11 and in the direction in which the cam 11 is rotatable. The cam surface 12 corresponds to the inner periphery of the cam groove 6 (FIGS. 32A and 32B) when the outer periphery of the groove 6 is removed. A pin 8*a* studded on the cam lever 8 is held in slidable contact with the cam surface 12. A switch gear 13 is formed at the base portion of the fulcrum about which the cam lever 8 is rotatable. The switch gear 13 is rotatably supported by support means, not shown, and held in mesh with a transmission gear 14. A transmission gear 15 is held in mesh with a gear 3 via an intermediate gear 16. A torque limiter 17 is connected to shafts 18*a* and 18*b* affixed to the transmission gears 14 and 15, respectively. When the cam lever 8 is brought into contact with a stationary member (e.g. control cam 11), the torque limiter 17 maintains the contact by generating a preselected load torque in the direction of forward and reverse rotation.

The counterclockwise rotation of the cam lever 8, as viewed in FIGS. 2A and 2B, is restricted by a stop 19. The stop 19, cam lever 8, clutch drum output portion 2, gear 3, spring clutch 4 and cam lever 8 constitute the clutch mechanism. A roller shaft 1*b* and clutch drum output portion 2 serve as a rotary shaft and a rotary member, respectively. The gear and spring clutch 4 serve as a transmission gear and drive coupling/uncoupling means, respectively. The cam lever 8 and control cam 11 constitute cancelling means. The cam lever 8 and its pin 8*a* play the role of moving means and that of a slide member, respectively.

In operation, to feed a paper from the paper feeder, the motor 9 is rotated in the forward direction. The rotation of the motor 9 is transferred to the gear 3 via a pinion gear 9*a* and a speed reduction gear 10. As a result, the gear 3 is rotated forward (counterclockwise as viewed in FIGS. 2A and 2B) and in turn causes the spring clutch 4 to fasten the drum portion 3*a* of the gear 3. Consequently, the clutch drum portion 2 and gear 3 are coupled together to rotate the pick-up roller 1 in the forward direction (preselected direction). At the same time, the control cam 11 is rotated in the same direction as the clutch drum portion 2 and spring clutch 4. Further, the rotation of the motor 9 is transmitted to the cam lever 8 via the gears 13, 14, 15 and 16, torque limiter 17 and shafts 18*a* and 18*b*, so that the lever 8 is rotated toward the control cam 11 until the pin 8*a* slidingly contacts the cam surface 12. At this instant, the torque limiter 17 generates a biasing force F due to an idle load torque and thereby maintains the pin 8*a* in sliding contact with the cam surface 12.

As shown in FIG. 2A, when the roller portion 1*a* is rotated to its reference position, i.e., when the clutch drum output portion 2 is rotated to its preselected position, the pin 8*a* abuts against a contact portion 12*a* included in the cam surface 12 and stops the rotation of the control cam 11. As a result, the other end 4*b* of the spring clutch 4 is opened in the direction opposite to the direction of forward rotation, causing the clutch 4 to unfasten the drum portion 3*a* of the gear 3. This interrupts the torque transmission from the motor 9 via the gear 3 and thereby stops the rotation of the roller portion 1*a* at its reference position. Because the spring clutch 4 has released the gear 3 from the clutch drum output portion 2, the torque of the motor 9 is not transferred to the roller shaft 1*b*. Hence, the motor 9 can be continuously rotated in the forward direction.

When the motor 9 is rotated in the reverse direction, the gear 3 is rotated in the same direction as the motor 9. However, because the spring clutch 4 does not connect the gear 3 to the clutch drum output portion 2, the gear 3 simply idles and prevents the torque of the motor 9 from being transferred to the roller shaft 1*b*. At the same time, the torque of the motor 9 is transmitted to the cam lever 8 via the gears 13–16, torque limiter 17 and shafts 18*a* and 18*b*. As a result, the cam lever 8 is moved away from the control cam 11 into contact with the stop 19. At this time, the torque limiter 17 generates the biasing force F in the opposite direction due to an idle load torque, so that the cam lever 8 is held in abutment against the stop 19. Because the clutch drum output shaft 8*a* and gear 3 are not connected to each other, and because the pin 8*a* spaced from the control cam 11 does not obstruct the rotation of the cam 11, the motor 9 can be continuously rotated in the reverse direction. This is contrastive to the end 6*d* of the conventional cam groove 6 (FIGS. 32A and 32B). Consequently, the driveline is prevented from locking even when other drivelines share the motor 9 with it.

As stated above, the illustrative embodiment allows the motor 9 to be continuously rotated in the forward or reverse direction, as desired. This, coupled with the pin 8*a* spaced from the control am 11, prevents the driveline from locking. The motor 9 can therefore be shared by a plurality of drivelines and reduces the cost. Because the clutch mechanism does not include any complicated arrangement, it is practicable with a minimum number of parts and is small size and simple. Because the cam lever 8 simply moves in a single plane, the clutch mechanism is reliable. Further, because the cam lever 8 is also driven by the motor 9, it does not need an exclusive drive source. In addition, each gear may be provided with any desired number of teeth because the cam lever 8 is driven by way of the gear 3.

Although the cam lever 8 is shown and described as being rotatable away from the control cam 11, it may be moved linearly away from the control cam 1.

2nd Embodiment

FIGS. 3–9 show an alternative embodiment of the present invention and also applied to an automatic paper feeder by way of example. In this embodiment, the same or similar constituents as or to the constituents of the first embodiment are designated by the same reference numerals, and a detailed description thereof will not be made in order to avoid redundancy.

Figure 3:
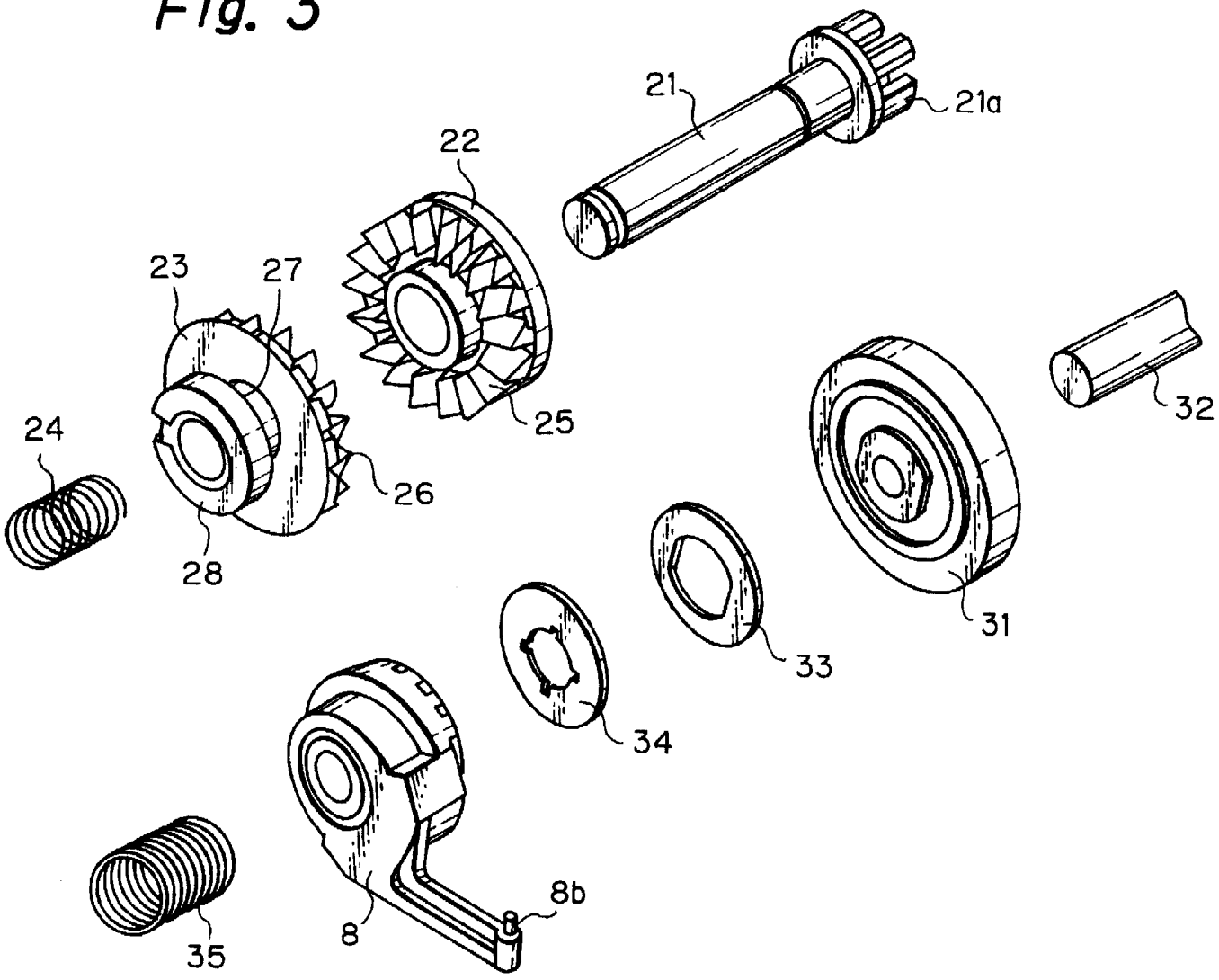
FIG. 3 is an exploded perspective view showing a second embodiment of the present invention.
Figure 4:
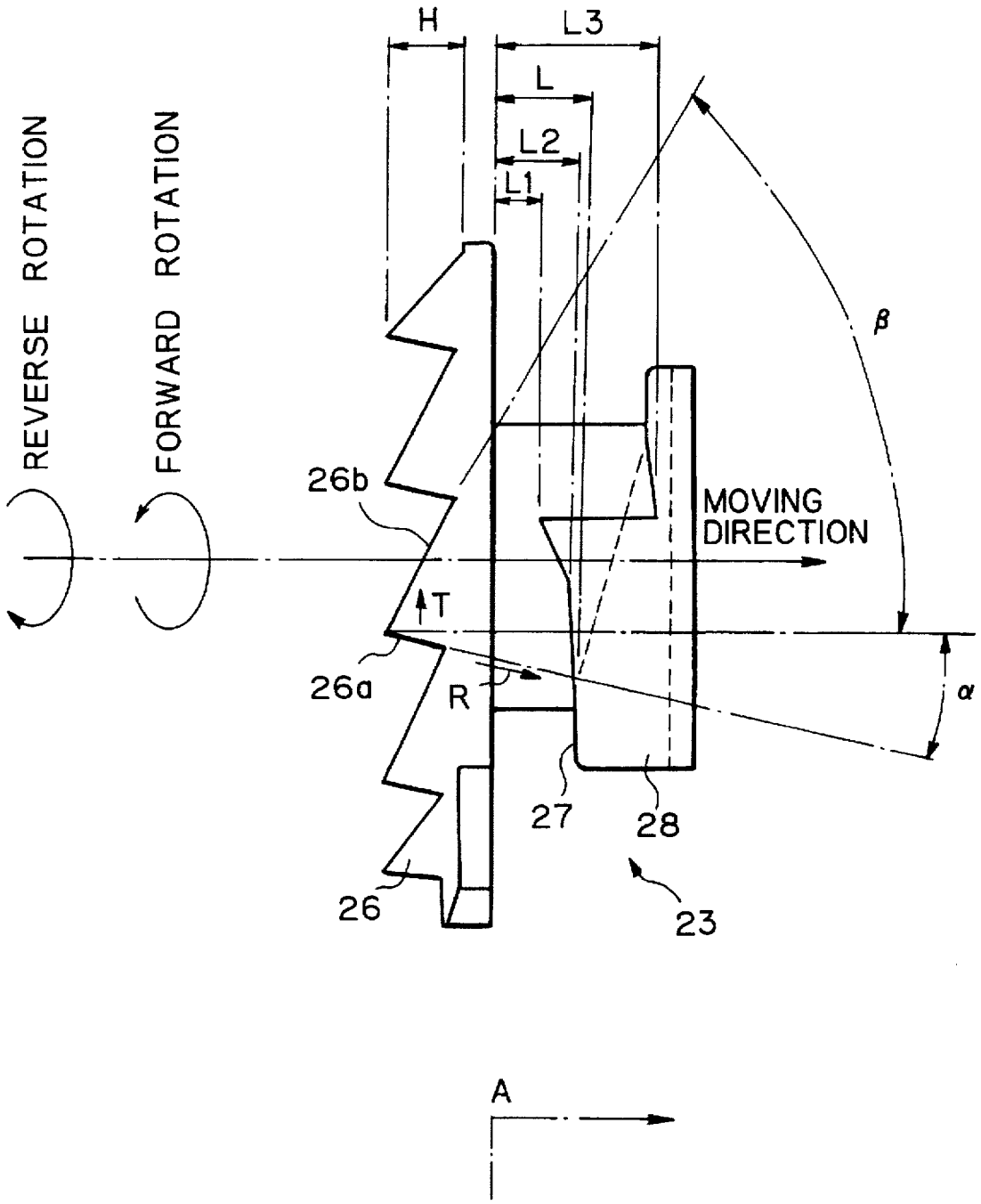
FIG. 4 is a fragmentary side elevation of the second embodiment.
Figure 8:
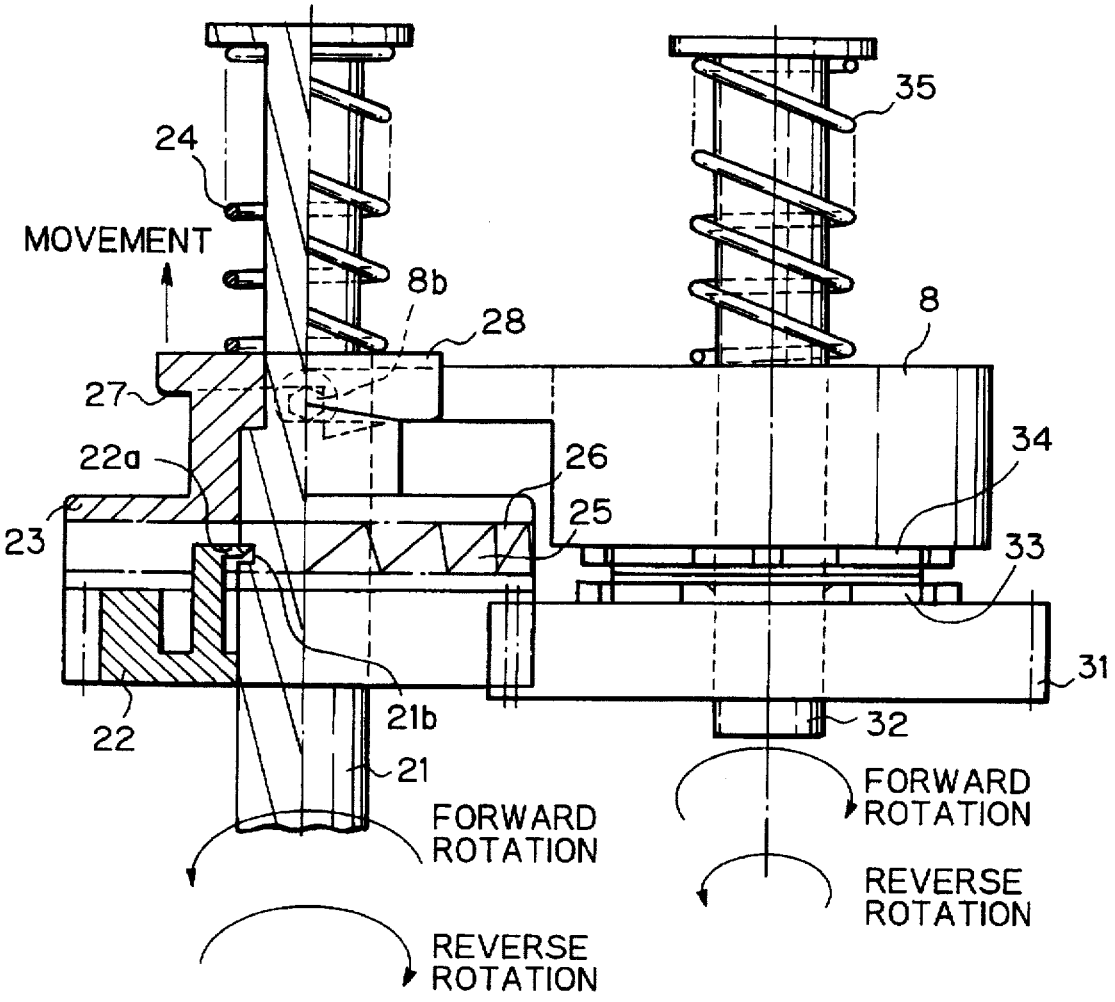
FIG. 8 is a view also demonstrating the operation of the second embodiment, but in a different direction from FIG. 7.

As shown in FIG. 3, a clutch shaft 21 corresponds to one end portion of the roller shaft 1*b* of the pick-up roller 1 and constitutes the roller shaft 1*b* with a meshing portion 21*a*. The end portion of the clutch shaft 21 is removed in a D-shaped section. The clutch shaft 21 is inserted into a clutch gear 22. As shown in FIG. 8, a circumferential groove 21*b* is formed in the clutch shaft 21 while a stop pawl 22*a* is formed on the clutch gear 22. The stop pawl 22*a* is received in the groove 21*b*, so that the clutch gear 22 is freely rotatable, but not movable in the axial direction of the clutch shaft 21. Teeth, not shown, are formed on the side of the clutch gear 22 and capable of meshing with another gear. A slide cam 23 is supported by the D-shaped portion of the clutch shaft 21 in such a manner as to be movable relative to the shaft 21 in the axial direction, but not rotatable relative to the shaft 21. The slide cam 23 is constantly biased by a spring 24 to contact the clutch gear 22 under a preselected pressure. The clutch gear 22 and slide cam 23 are respectively formed with ratchet portions 25 and 26 on their facing ends. A cam portion 28 is formed on the other end of the slide cam 23. As best shown in FIG. 4, the cam portion 28 has a cam surface 28 perpendicular to the axis of the slide cam 23 on the clutch gear 22 side thereof. The clutch shaft 21, clutch gear 22 and slide cam 23 respectively serve as a rotary shaft, a transmission gear, and a rotary member. Further, the spring 24 plays the role of biasing means.

A switch gear 31 is mounted on a stationary shaft 32 affixed to an apparatus body and freely rotatable relative to the shaft 32, but not movable in the axial direction. Teeth, not shown, are formed on the peripheral face of the switch gear 31. The clutch gear 22 and a transmission gear 36 (FIG. 7) are held in mesh with the teeth of the switch gear 31. The output torque of the motor 9 is transmitted to the transmission gear 36 via a gear train, not shown. Disks 33 and 34 are respectively affixed to the face of the cam lever 8 and that of the switch gear 31 which face each other. A spring 35 constantly biases the cam lever 8, which is rotatably and axially movably supported by the cam lever 8, toward the switch gear 31 with a preselected biasing force, so that the disks 33 and 34 are pressed against each other. In this condition, the disks 33 and 34 constitute a torque limiter for generating a preselected load torque (idle torque) in the reversible direction.

In this embodiment, a pin 8*b* is studded on the cam lever 8 and extends in the direction of rotation to slidingly contact the cam surface 27 of the slide cam 23. The disks 33 and 34 are omissible if the cam lever 8 and switch gear 31 are formed of materials capable of stably generating friction to act between the disks 33 and 34; that is, the lever 8 and gear 31 may directly contact each other to constitute a torque limiter.

Figure 5:
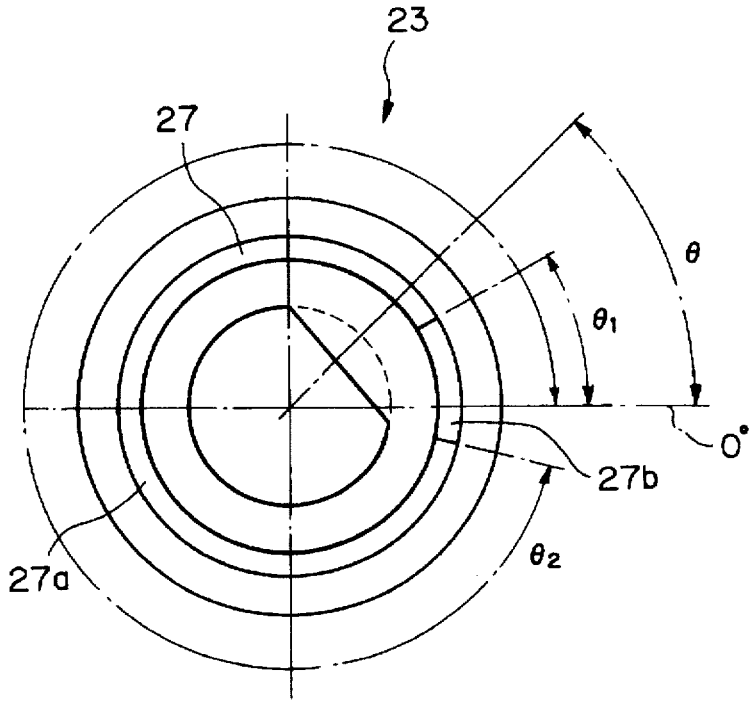
FIG. 5 is a view of the second embodiment as seen in a direction indicated by an arrow A in FIG. 4.
Figure 6:
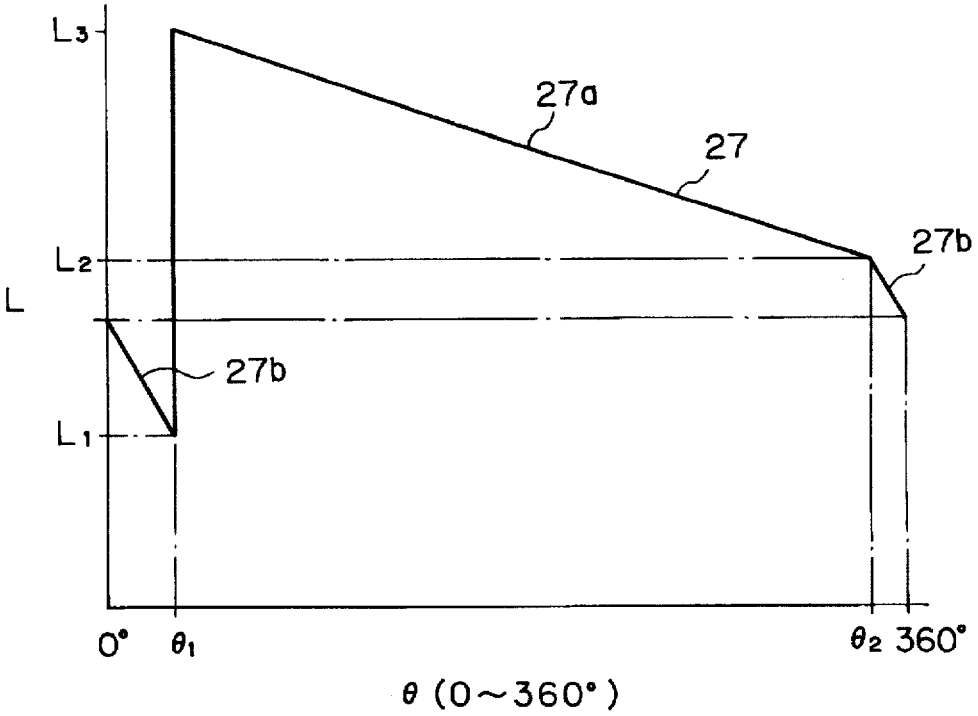
FIG. 6 is a fragmentary view of a part of the arrangement shown in FIG. 4.

As shown in FIGS. 4, 5 and 6, the ratchet portions 25 and 26 (only the ratchet portion 26 is shown) are provided with a substantially identical configuration, so that they contact each other over their entire faces under the action of the spring 24. The ratchet portions 25 and 26 respectively include slant surfaces 25*a* and 26*a* inclined by an angle $\alpha$ to the common axis. During the forward rotation of the clutch gear 22, the slant surfaces 25*a* and 26*a* contact each other in order to cause the slide cam 23 to rotate. A surface pressure T to act when the slide cam 23 tends to move away from the slide clutch 22 during the forward rotation is selected to be smaller than the sum of the force of the spring 24 and a frictional force R acting between the inclined surfaces 25*a* and 26*a*. This allows the clutch gear 22 and slide cam 23 to mesh with each other without having their ratchet portions 25 and 26 being displaced from each other.

Further, the ratchet portions 25 and 26 respectively have slant surfaces 25*b* and 26*b* contacting each other in the event of reverse rotation. The slant surfaces 25*b* and 26*b* are inclined by an angle $\beta$ to the common axis in order to cause the clutch gear 22 to idle during the course of reverse rotation. In the event of reverse rotation, the surface pressure T to act when the slide cam 23 tends to move away from the slide clutch 22 is selected to be greater than the sum of the bias of the spring 24 and the frictional force R acting between the slant surfaces 25*b* and 26*b*. This allows the clutch gear 22 to be released from the slide cam 23 with the previously mentioned contact position thereof displaced. In this sense, the ratchet portions 25 and 26 constitute coupling/uncoupling means.

As shown in FIGS. 5 and 6, assume that when the roller portion 1*b* of the pick-up roller 1 is held in its reference position, the slide cam 23 has a rotation angle $\theta$ of zero degree. Then, the cam portion 28 of the slide cam 23 is so configured as to contact the pin 8*b* of the cam lever 8 when the ratchet portions 25 and 26 fully contact each other with the cam surface 27 rotated by $+\theta 1$ degrees from the zero degree position and spaced from the rear of the ratchet portion 26 by a distance L3. In the event of forward rotation, when the cam surface 27 rotated by $\theta 2$ degrees from a $+\theta$ degree position is spaced from the rear of the ratchet portion 26 by a distance L2, it is pressed by the pin 8*b* of the cam lever 8 to the right, as seen in FIG. 4, with the result that the ratchet portion 26 is released from the ratchet portion 25. In this manner, the axial distance (L3 - L2) derived from the rotation of the cam surface 27 from $+\theta 1$ to $\theta 2$ coincides with the height H of the ratchet portion 26. Only if the angular position $\theta 2$ of the cam surface 27 spaced by the distance L2 from the rear of the ratchet portion 26 is provided with a desired angle, the slide cam 23 can stop its rotation at the above position and can cause the clutch shaft 21 to stop rotating at a preselected angular position. In this sense, the cam portion 28 constitute cancelling means.

The positional accuracy of the cam lever 8 in the axial direction is irregular, depending on the machining accuracy and assembling accuracy of parts. To allow the ratchet portions 25 and 26 to be released even when the pin 8*b* of the dam lever 8 is positioned closest to the clutch gear 22 (sometimes referred to as inward in the axial direction hereinafter) due to the above irregularity, the cam surface 27 is so configured as to be spaced from the rear of the ratchet portion 26 by a distance L1 when further rotated from the $\theta 2$ degree position forward by $-\theta 1$ degrees, as measured from zero degree. When the cam surface 27 rotates from the $\theta 1$ degree position to the $-\theta$ degree position by way of the $\theta 2$ degree position, its distance from the rear of the ratchet portion 26 sequentially decreases from L3 to L1 by way of L2. Further, the distance L2 is selected such that even when the pin 8*b* is positioned farthest from the clutch gear (sometimes referred to as outward in the axial direction hereinafter) due to the irregularity, the ratchet portions 25 and 26 are released when the cam surface 27 is rotated to the $\theta 2$ degree position. The angles $\theta 2$ through $-\theta$ are so selected as to cause the slide cam 23 to stop the roller portion 1*a* at its reference position. When the pin 8*b* is located at an average position, the roller portion 1*a* is stopped at zero degree (ideal position) between the angles $\theta 2$ and $-\theta$. In this manner, the portion of the cam surface 27 lying in the range of from +θ1 to θ2 constitutes a first slide surface 27a while the portion of the same lying in the range of from θ2 to −θ1 constitutes a second slide surface 27b. This successfully tolerates the machining errors and assembling errors of the parts.

Figure 7:
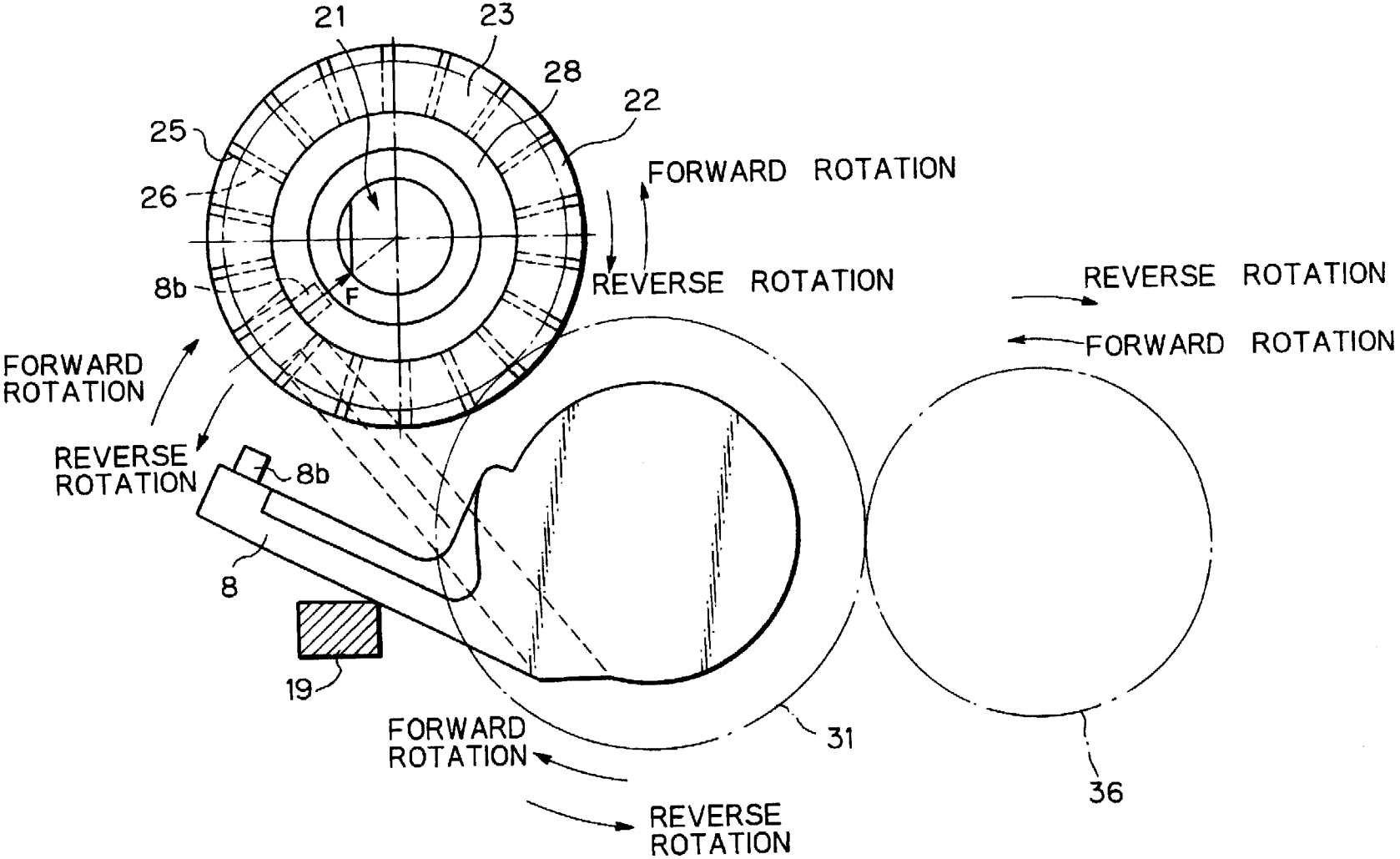
FIG. 7 is a view demonstrating the operation of the second embodiment and as seen in the axial direction.
Figure 9:
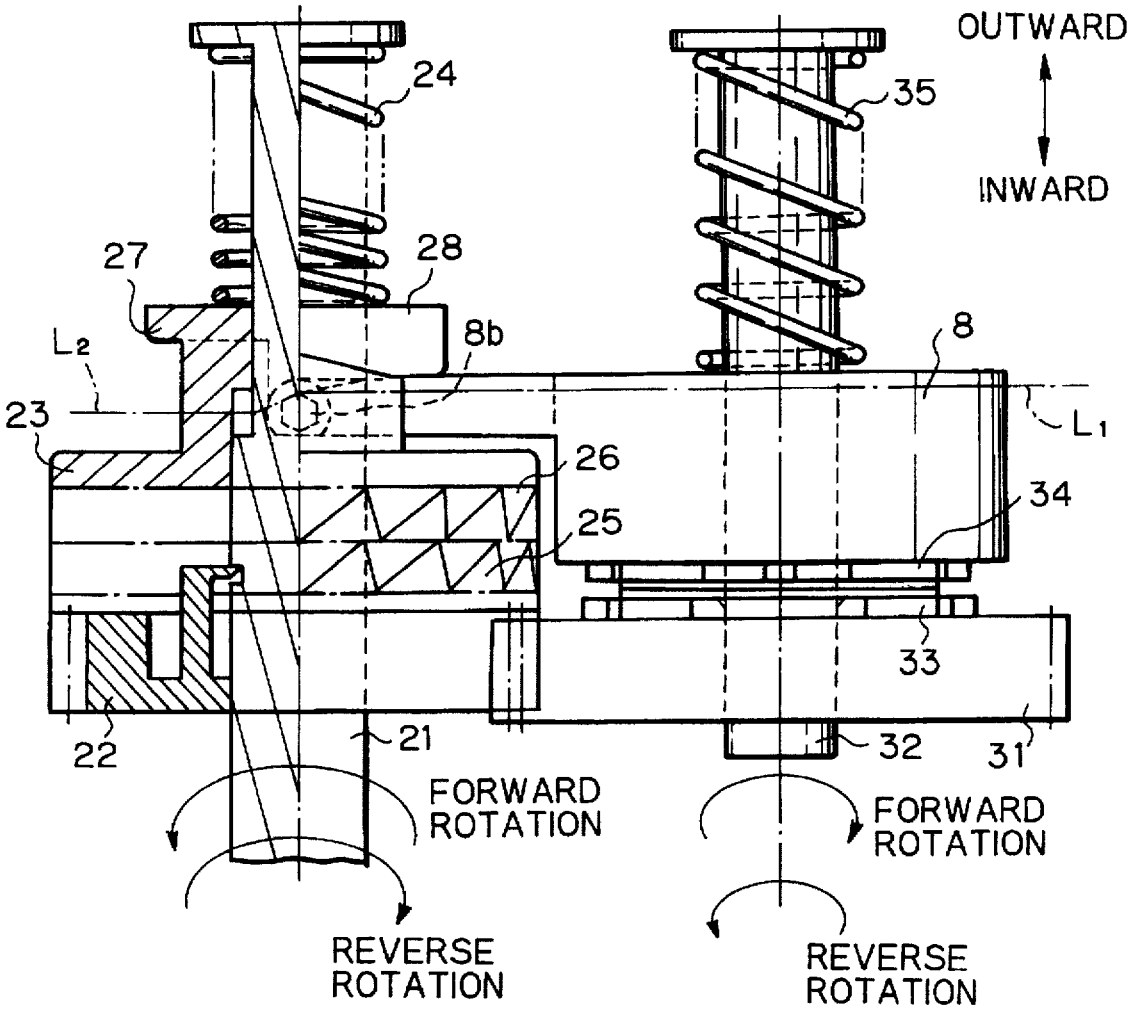
FIG. 9 is a view as seen in a different direction from FIG. 8.

The operation of this embodiment will be described with reference to FIGS. 7–9. As shown, when the motor 9 is rotated forward in order to feed a paper, the rotation of the motor 9 is transmitted to the switch gear 31 and clutch gear 22 via the previously mentioned gear train including the transmission gear 36. As a result, the slide cam 23 is rotated forward without the previously mentioned contact position of the ratchet portions 25 and 26 contacting over their entire faces being displaced. The slide cam 23 in turn causes the clutch shaft 21 (roller shaft 1b) to rotate forward. At the same time, the cam lever 8 abutting against the stop 19 is rotated from a solid line position to a phantom line position shown in FIG. 7 via the switch gear 31 and disks 25 and 26. As a result, the cam lever 8 contacts the slide cam 23. At the same time, as shown in FIG. 8, the pin 8b begins to slide on the first slide surface 27a of the cam surface 27 from the +θ1 degree position of the slide cam 23. At this instant, the disks 25 and 26 begins to slide on each other. The resulting idle load torque turns out the biasing force F with which the cam lever 8 urges the slide cam 23. In this condition, the pin 8b of the cam lever 8 and the cam surface 27 are held in sliding contact with each other.

Further, when the slide cam 23 is rotated from +θ1 to θ2, the distance between the pin 8b and the rear of the ratchet portion 26 changes from L3 to L2. As a result, the slant surfaces 25a and 26a of the ratchet portions 25 and 26 are displaced from each other, so that the clutch gear 22 and slide cam 23 are sequentially released from each other. Because the slant surfaces 25a and 26a are inclined by the angle α to the common shaft, the surface pressure T during the forward rotation acts also in the direction in which the slide cam 23 moves away from the slide clutch 22. Hence, the load of the motor 9 for displacing the slant surfaces 25a and 26a is successfully reduced.

Subsequently, the portion of the cam surface 27 slidingly contacting the pin 8b of the cam lever 8 turns out the second slide surface 27b. When the slide cam 23 is rotated to about zero degree between θ2 and −θ1, the roller portion 1a reaches its reference position. As a result, the ratchet portions 25 and 26 are released from each other, as shown in FIG. 9. This interrupts the drive transmission from the clutch gear 22 to the slide cam 23 and thereby stops the rotation of the clutch shaft 21 (roller shaft 1b). Consequently, the roller portion 1a is brought to a stop at the reference position. Because the rotation of the motor 9 is not transferred to the clutch shaft 21, the motor 9 can be continuously rotated in the forward direction.

When the motor 9 is rotated in the reverse direction, it rotates the cam lever 8 in the reverse direction via the switch gear 31 and disks 25 and 26. When the cam lever 8 reaches a position indicated by a solid line in FIG. 7, the pin 8b leaves the cam surface 27 and abuts against the stop 19. When the pin 8b leaves the cam surface 27, the slide cam 23 is moved toward the clutch gear 22 by the spring 24 until the ratchet portions 25 and 26 fully mate with each other. At this instant, the cam lever 8 abuts against the stop 19 due to the biasing force F derived from the reverse idle load torque acting between the disks 25 and 26, as during the forward rotation. Even when the motor 9 is deenergized, the disks 25 and 26 maintain the cam lever 8 in contact with the stop 19 due to a preselected frictional force derived from the spring 35.

The reverse rotation of the motor 9 is transmitted to the clutch gear 22 via the gear train including the transmission gear 36 and the switch gear 31. As the clutch gear 22 is rotated in the reverse direction, the slide cam 23 leaves the clutch gear 22 while displacing the contact position of the ratchets 25 and 26. However, when the ratchet portions 25 and 26 go beyond their apexes, they are again brought into full contact with each other due to the action of the spring 24. This is repeated to cause the clutch gear 22 to idle. In this condition, the rotation of the motor 9 is not transferred to the slide cam 23. At the same time, the pin 8b of the cam lever 8 is spaced from the slide cam 23 and does not obstruct the rotation of the control cam 11. This is contrastive to the end 6d of the conventional cam groove 6 (FIGS. 32A and 32B). The motor 9 can therefore be continuously rotated in the reverse direction. It follows that the driveline is prevented from locking even when it shares the motor 9 with other drivelines. The above procedure is repeated to couple and uncouple the clutch mechanism.

This embodiment has the following advantages in addition to the advantages of the first embodiment. The drive transmission from the motor 9 can be set up and interrupted by the ratchet portions 25 and 26 without resorting to the spring clutch 4 of the first embodiment. Hence, the forward and reverse rotation of the motor 9 can be continued by an inexpensive simple construction which further reduces the cost. Further, because the torque limiter is implemented by friction acting between the disks 25 and 26, it is simple and inexpensive. Moreover, the cam surface 27 of the slide cam 23 slidingly contacting the pin 8b is constituted by the first and second slide surfaces 27a and 27b which allow tolerate the machining and assembling errors of members. Therefore, the roller portion 1b of the pick-up roller 1 can be surely brought to a stop at its reference position, enhancing the reliable operation of the clutch mechanism.

3rd Embodiment

Figure 10:
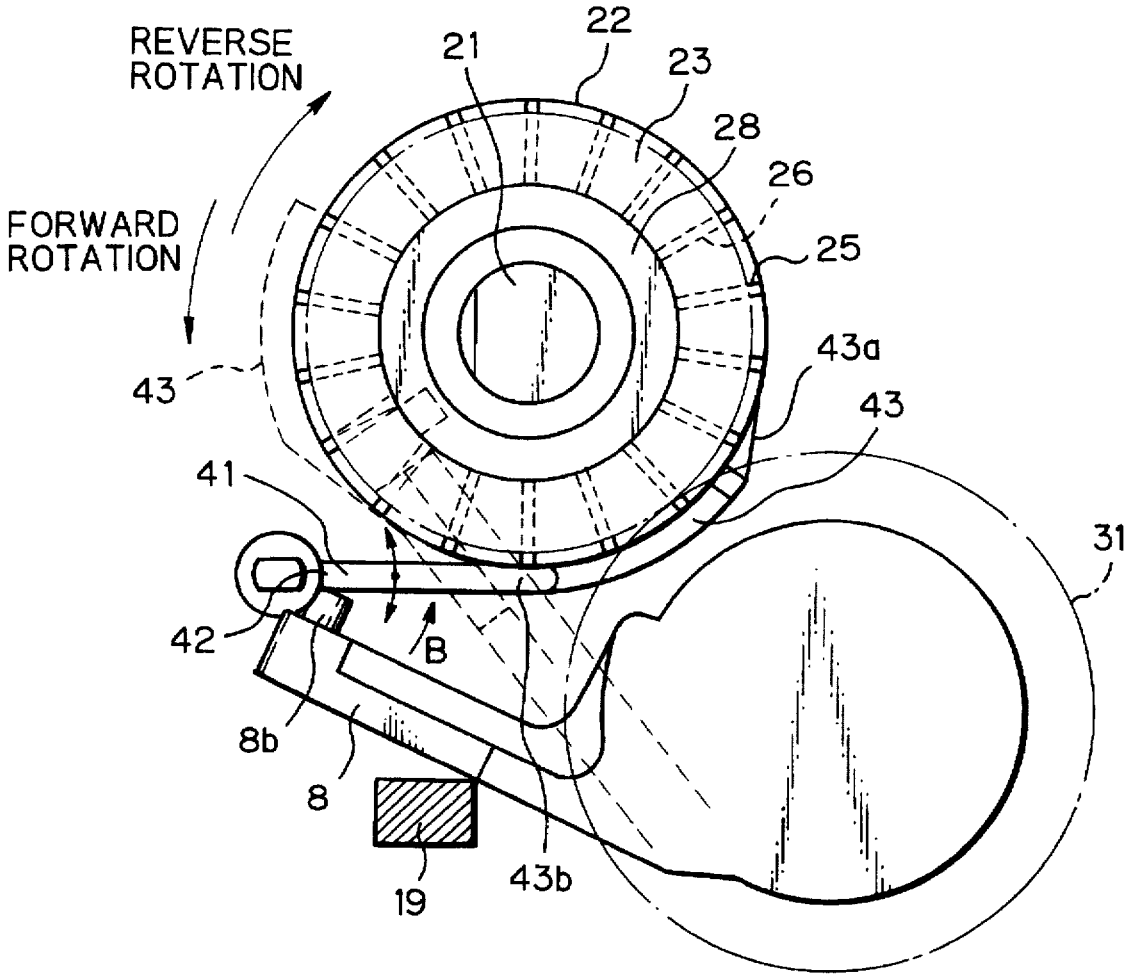
FIG. 10 is a view showing a third embodiment of the present invention.
Figure 11:
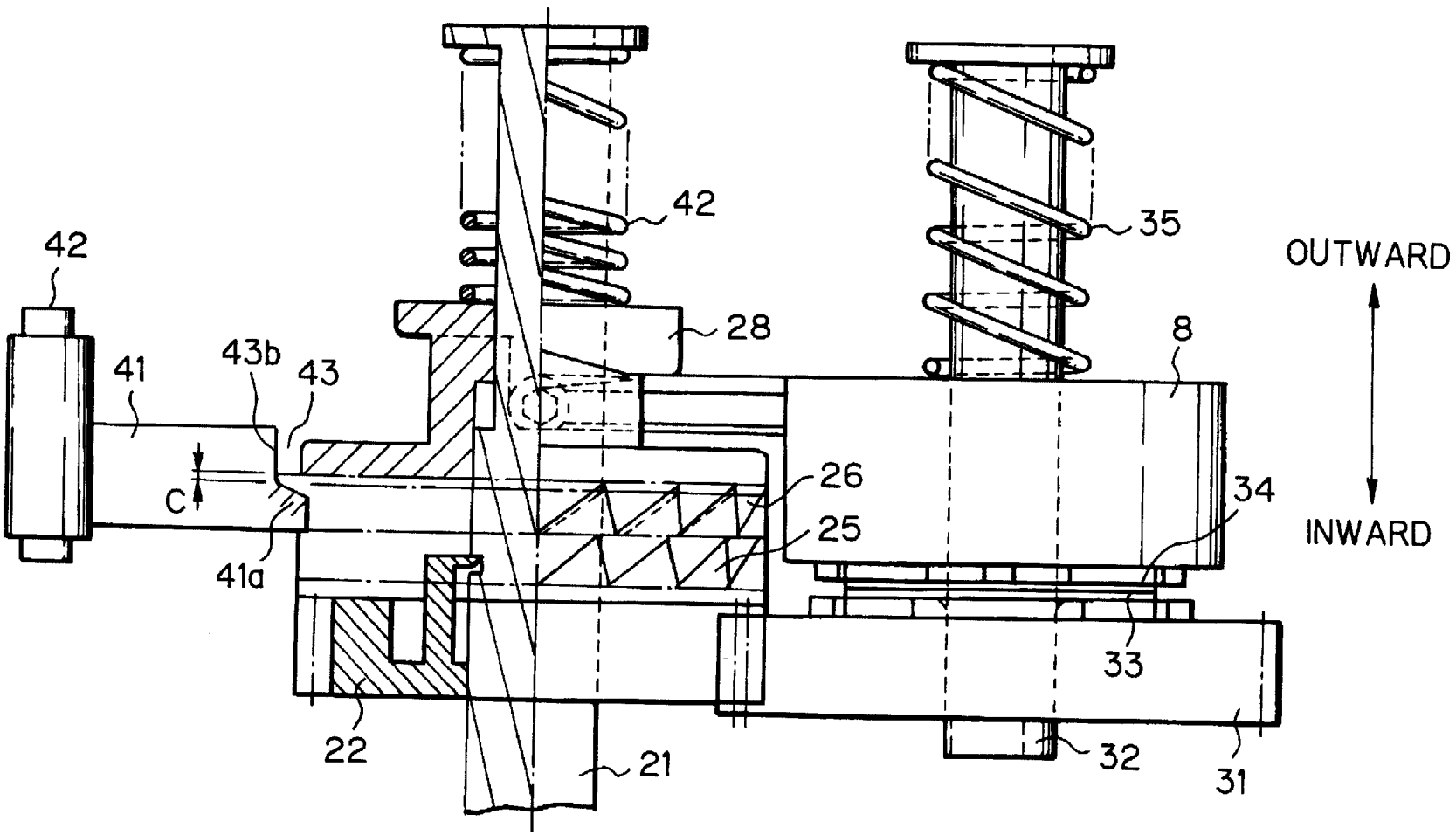
FIG. 11 is a view as seen in a different direction from FIG. 10.

Referring to FIGS. 10 and 11, another alternative embodiment of the present invention will be described which is also applied to an automatic paper feeder. In this embodiment, the same or similar constituents as or to the constituents of the second embodiment are designated by the same reference numerals, and a detailed description thereof will not be made in order to avoid redundancy.

As shown, a stop lever or stop member 41 is rotatably supported by a support member 42 at its base end. The stop lever 41 extends in the direction of forward rotation of the slide cam 23. Biasing means, not shown, constantly biases the stop lever 41 in a direction B such that the free end of the lever 41 slidingly contacts the peripheral face of the slide cam 23. The peripheral face of the slide cam 23 which the stop lever 41 contacts is partly protruded radially outward to form an abutment 43. A slant surface 43a is formed at the leading end of the slide cam 23 with respect to the direction of forward rotation and is substantially coincident with a line tangential to the slide cam 23. The abutment 43 has an end face 43b at its leading end with respect to the direction of reverse rotation of the slide cam 23. The end face 43b is substantially perpendicular to a line tangential to the slide cam 23 and so positioned as to be slightly spaced from the free end of the stop lever 41 when the ratchet portions 25 and 26 are uncoupled.

The stop lever 41 has a projection or space maintaining means 41a at its free end. The projection 41a projects in the direction of forward rotation of the slide cam 23 more than the face of the stop lever 41 which abuts against the end face 43*b* of the abutment 43. When the ratchet portions 25 and 26 are released from each other due to the forward rotation of the slide cam 23, the projection 41*a* will be positioned more inward than the abutment 43 in the axial direction by a distance C (FIG. 11). The distance C is smaller than the height H of the ratchet portions 25 and 26.

In operation, when the motor 9 and therefore the slide cam 23 is rotated in the forward direction, the stop lever 41 slides on the slide cam 23 over the abutment 43 without abutting against the abutment 43. This is because the stop lever 41 extends in the direction of forward rotation of the slide cam 23 and because the slant surface 43*a* of the abutment 43 is substantially coincident with the line tangential to the cam 23. Therefore, the stop lever 41 does not obstruct the forward rotation of the slide cam 23, so that the driveline is prevented from locking.

Assume that the motor 9 is reversed after the ratchet portions 25 and 26 have been fully released from each other, i.e., after the roller portion 1*a* of the pick-up roller 1 has been brought to its reference position. Then, the ratchet portions 25 and 26 displace their contact position and cause the clutch gear 22 to idle. At this instant, a reverse idle torque acts on the slide cam 23 due to a frictional force R acting between the slant surfaces 25*b* and 26*b* of the ratchet portions 25 and 26, tending to rotate the slide cam 23 in the reverse direction. However, because the end face 43*b* of the abutment 43 is substantially perpendicular to the line tangential to the slide cam 23, the end of the stop lever 41 abuts against the abutment 43 and prevents the slide cam 23 from rotating. Consequently, the roller portion 1*a* of the pick-up roller 1 is held in its reference position.

Because the reverse rotation of the motor 9 causes the pin 8*b* of the cam lever 8 to leave the cam surface 27, the slide cam 23 begins to move toward the clutch gear 22 due to the action of the spring 24. However, when the slide cam 23 fully moves the distance C from a position indicated by a solid line in FIG. 11 to a position indicated by a phantom line, the abutment 43 of the cam 23 is stopped by the projection 41*a* of the stop lever 41. It follows that the slant surfaces 25*b* and 26*b* at which the ratchet portion 25 contacts the ratchet portion 26 lie in the range C. The contact area decreases with a decease in the distance C.

This embodiment has the following advantages in addition to the advantages of the second embodiment. During the reverse rotation of the motor 9, the reverse idle torque acts on the slide cam 23. However, because the stop lever 41 abuts against and stops the abutment 43, the slide cam 23 is prevented from being rotated in the reverse direction and surely maintains the clutch shaft 21 at its preselected angular position. The end face 43*b* of the abutment 43 is positioned such that when the ratchet portions 25 and 26 are released from each other, the end face 43*b* is slightly spaced from the end of the stop lever 41. Hence, the roller portion of the pick-up roller 1 brought to a stop at its reference position can be maintained in the reference position.

During the forward rotation of the motor 9, the stop lever 41 angularly moves in sliding contact with the abutment 43 and does not stop the slide cam 23. This prevents the driveline from locking and thereby enhance the reliable operation of the clutch mechanism.

Furthermore, during the reverse rotation of the motor 9, the projection 41*a* of the stop lever 41 does not allow the cam 23 to move toward the clutch 22 by more than the distance C from the condition wherein the ratchet portions 25 and 26 are spaced from each other. Therefore, the idle torque acting on the slide cam 23 is confined only in the slant surfaces 25*b* and 26*b* of the ratchet portions 25 and 26 which slidingly contact within the distance C. As a result, there can be reduced the variation of the load acting on the motor 9 due to the friction R acting between the slant surfaces 25*b* and 26*b*. In addition, because the ratchet portions 25 and 26 contact over a small area, noise ascribable to the repeated contact is reduced.

4th Embodiment

Figure 12:
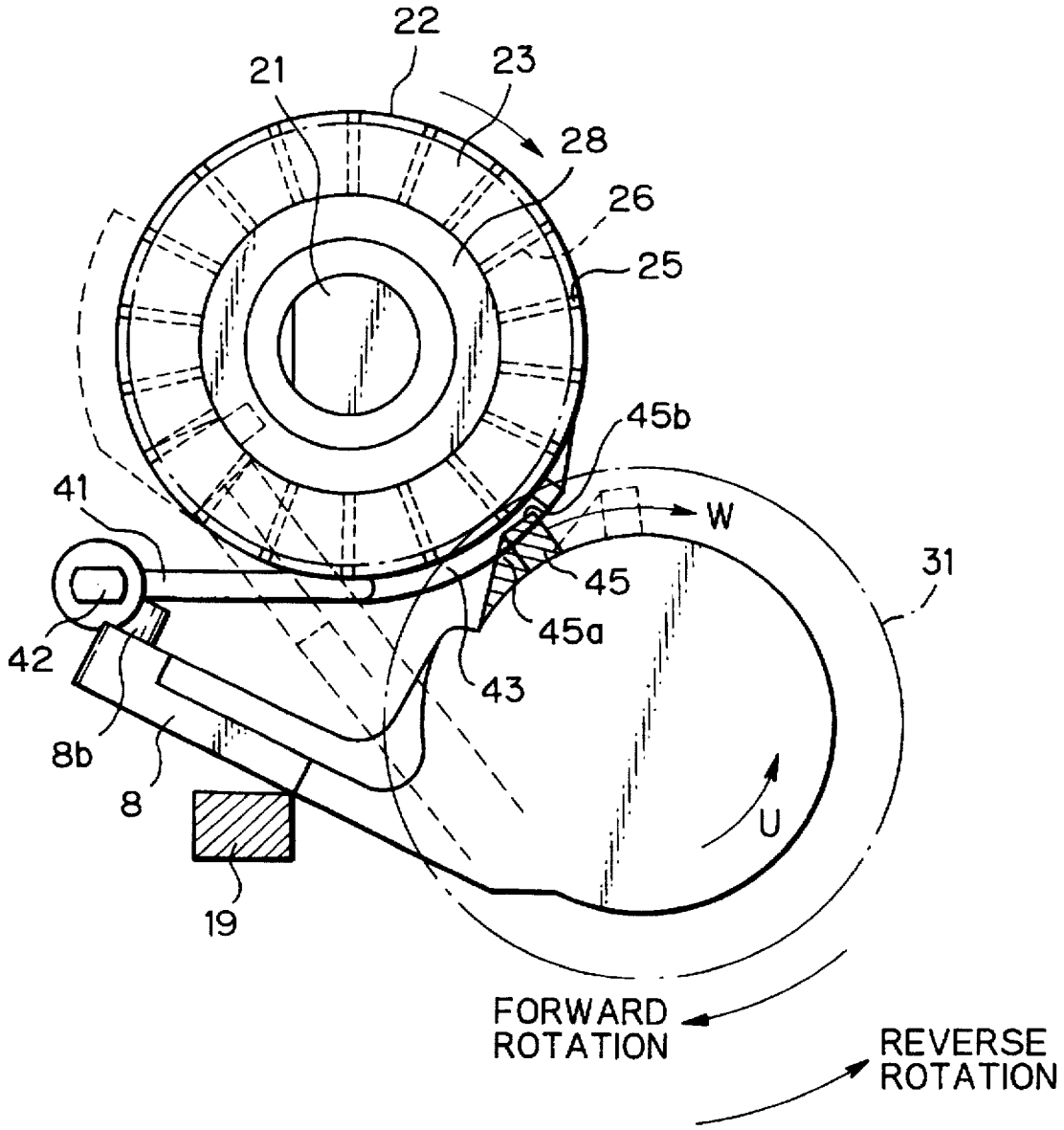
FIG. 12 is a view showing a fourth embodiment of the present invention.
Figure 13:
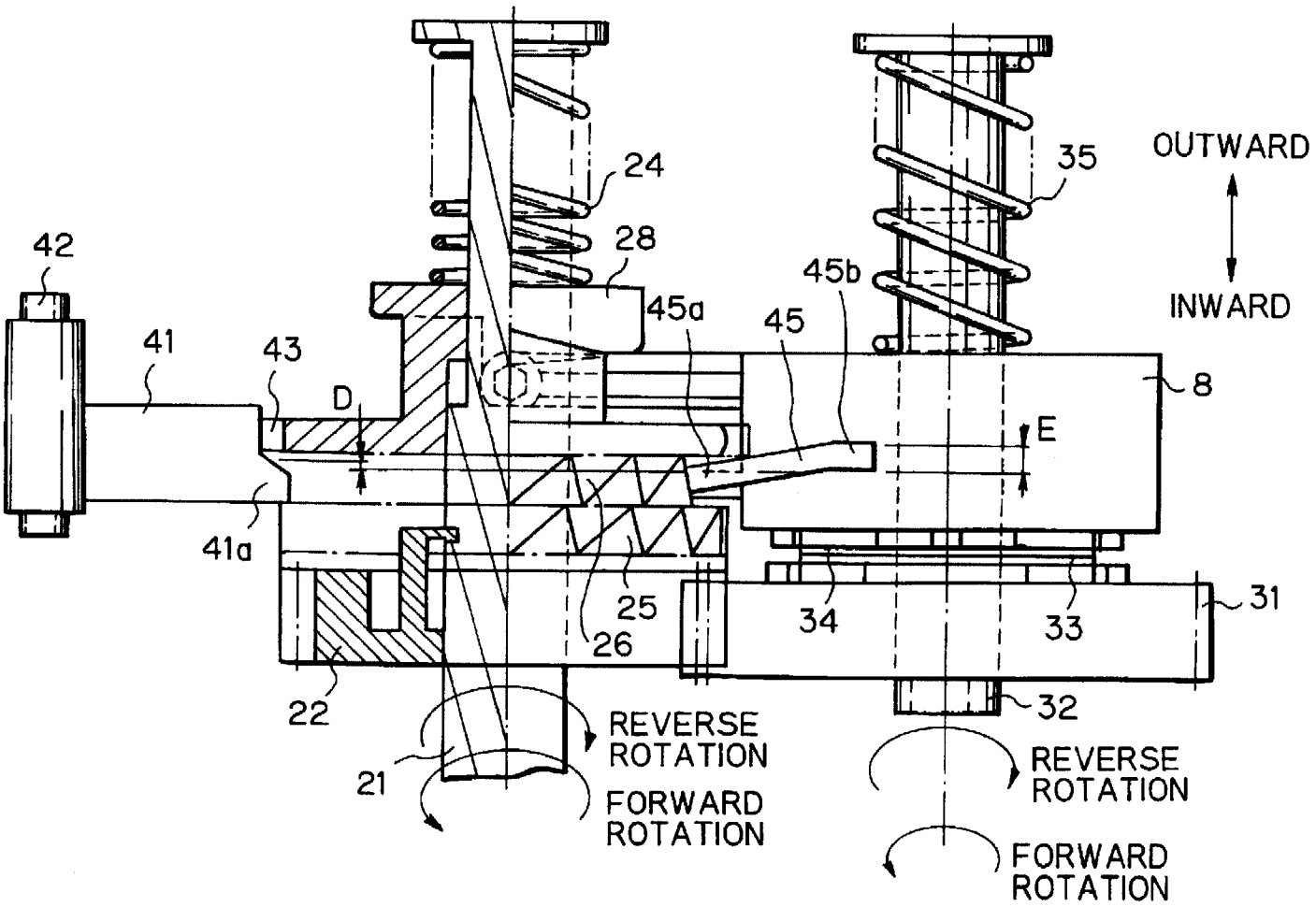
FIG. 13 is a view as seen in a different direction from FIG. 12.
Figure 14:
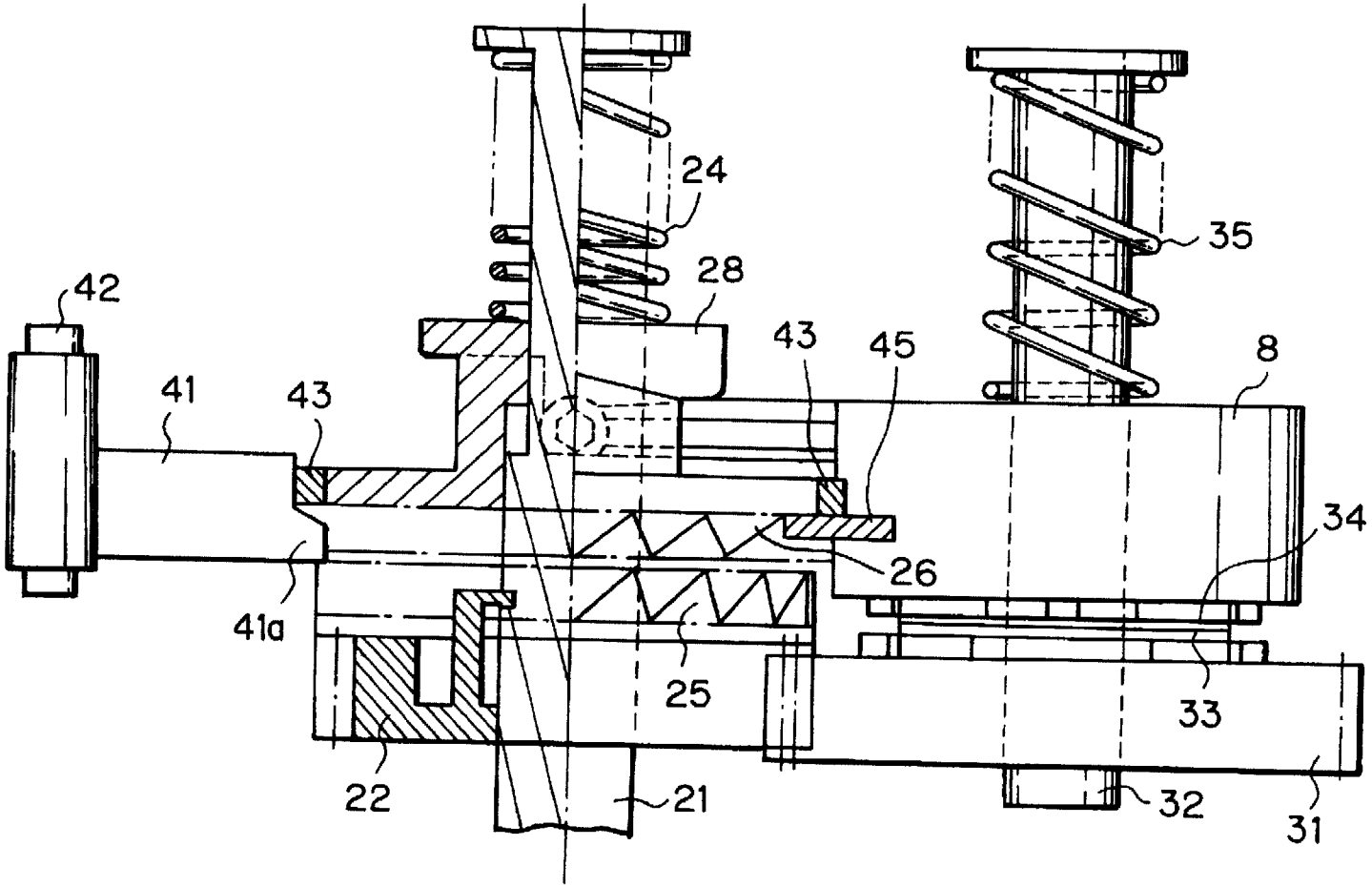
FIG. 14 is a view demonstrating the operation of the fourth embodiment and as seen in a different direction from FIG. 13.

FIGS. 12–14 show another alternative embodiment of the present invention also applied to an automatic paper feeder. In this embodiment, the same or similar constituents as or to the constituents of the third embodiment are designated by the same reference numerals, and a detailed description thereof will not be made in order to avoid redundancy.

As shown in FIGS. 12 and 13, the cam lever 8 has a cam portion or space maintaining means 45 on the peripheral face of its base portion. The cam portion 45 is positioned such that when the cam lever 8 is rotated toward the stop 19 after the end of the stop lever 41 has abutted against the end face 43 of the abutment 43 to stop the reverse rotation of the slide cam 23, the cam portion 45 moves from a position indicated by a phantom line in FIG. 12 to a position indicated by a solid line and where it contacts the abutment 43. As shown in FIG. 13, the leading end 45*a* of the cam portion 45 in the direction of reverse rotation of the cam lever 8 has its outer surface in the axial direction positioned more inward than the projection 41*a* of the stop lever 41 in the axial direction by a distance D. The trailing end 45*b* of the cam portion 45 in the above direction has its outer surface positioned outward of the leading end 45*a* by a distance E in the axial direction. The distance E is selected to be greater than the sum of the distances C and D. A load torque W derived from the friction between the cam 45 and the abutment 43 is smaller than an idle torque U derived from the friction between the disks 33 and 34.

In operation, assume that after the motor 9 and therefore the slide cam 32 has been rotated in the forward direction to release the ratchet portions 25 and 26, the motor 9 is reversed. Then, the cam lever 8 moves from a position indicated by a phantom line in FIG. 12 to a position indicated by a solid line, releasing the pin 8*b* from the cam surface 27 of the slide am 23. At the same time, the cam lever 8 begins to contact the abutment 43 at the leading end 45*a* of the cam portion 45. When the cam lever 8 abuts against the stop 19, the trailing end 45*b* thereof contacts and supports the abutment 43. In this manner, the cam portion 45 supports the abutment 43. Hence, the slide cam 23 does not move toward the clutch gear 22, so that the ratchet portions 25 and 26 are held in their spaced positions. As shown in FIG. 14, when the abutment 43 contacts the trailing end 45*b* of the cam portion 45, the ratchet portions 25 and 26 are further spaced from each other. In this condition, even if the motor 9 is continuously rotated in the reverse direction, the ratchet portions 25 and 26 do not contact each other and prevent the slide cam 23 from rotating in the reverse direction due to the previously mentioned idle torque.

When the motor 9 is again rotated in the forward direction, the cam lever 8 moves from the solid line position to the phantom line position shown in FIG. 12. As a result, the cam 45 is released from the abutment 43. Then, the slide cam 23 moves toward the clutch gear 22 due to the action of the spring 24. As soon as the ratchet portions 25 and 26 fully contact each other, the slide cam 23 is rotated in the same direction as the motor 9.

This embodiment has the following advantages in addition to the advantages of the third embodiment. During the reverse rotation of the motor 9, the cam portion 45 of the cam lever 8 contacts the abutment 43 of the slide cam 23 and maintains the ratchet portions 25 and 26 spaced from each other. This frees the slide cam 23 from an idle torque to thereby reduce the load to act on the motor 9 and reduces noise ascribable to the abutment of the ratchet portions 25 and 26 against each other.

During the forward rotation of the motor 9, the cam portion 45 is released from the abutment 43 of the slide cam 23. In this condition, the ratchet portions 25 and 26 fully contact each other and transmit the forward rotation of the motor 9 to the clutch shaft 21.

5th Embodiment

Figure 15:
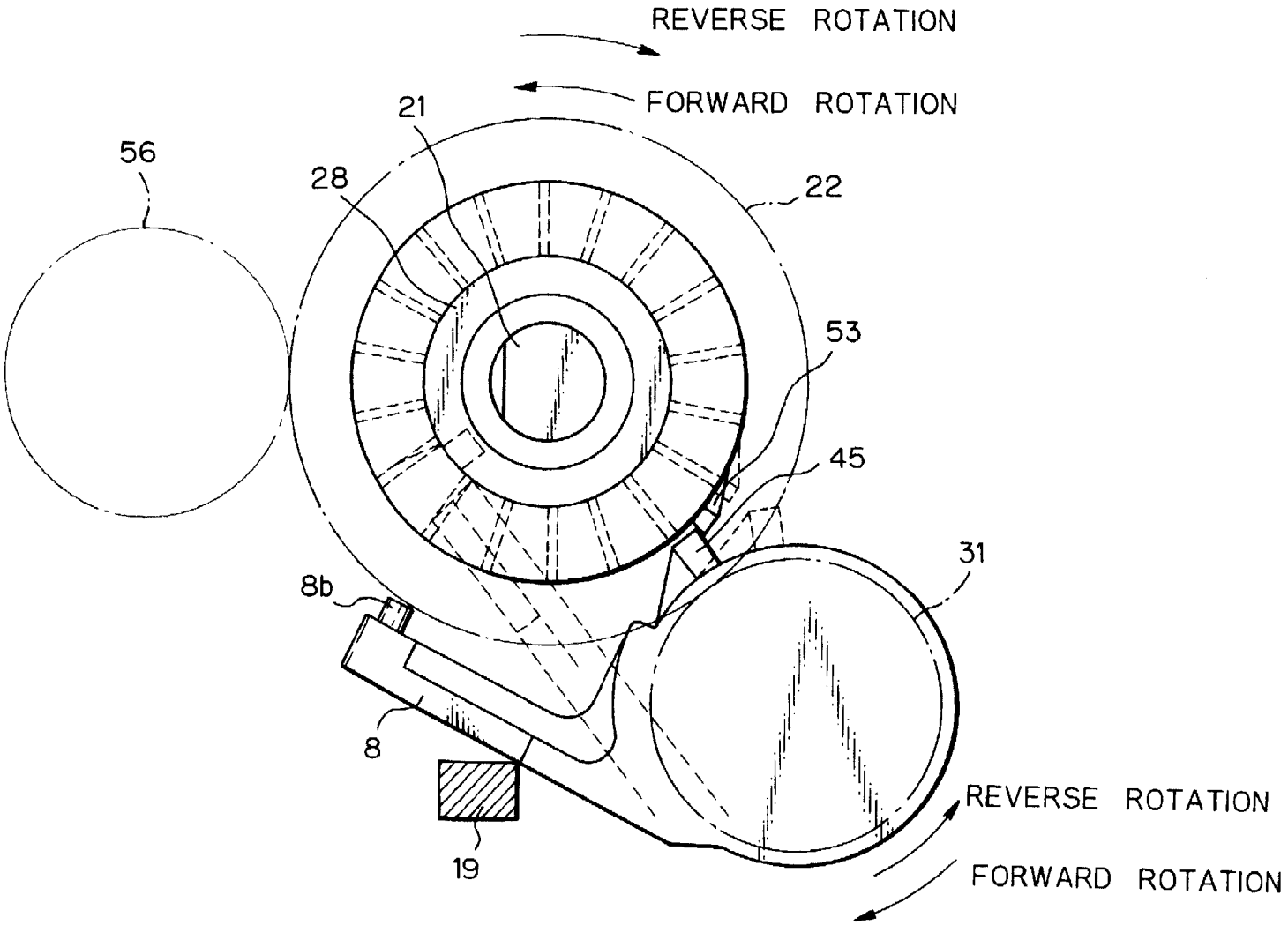
FIG. 15 is a view showing a fifth embodiment of the present invention.
Figure 16:
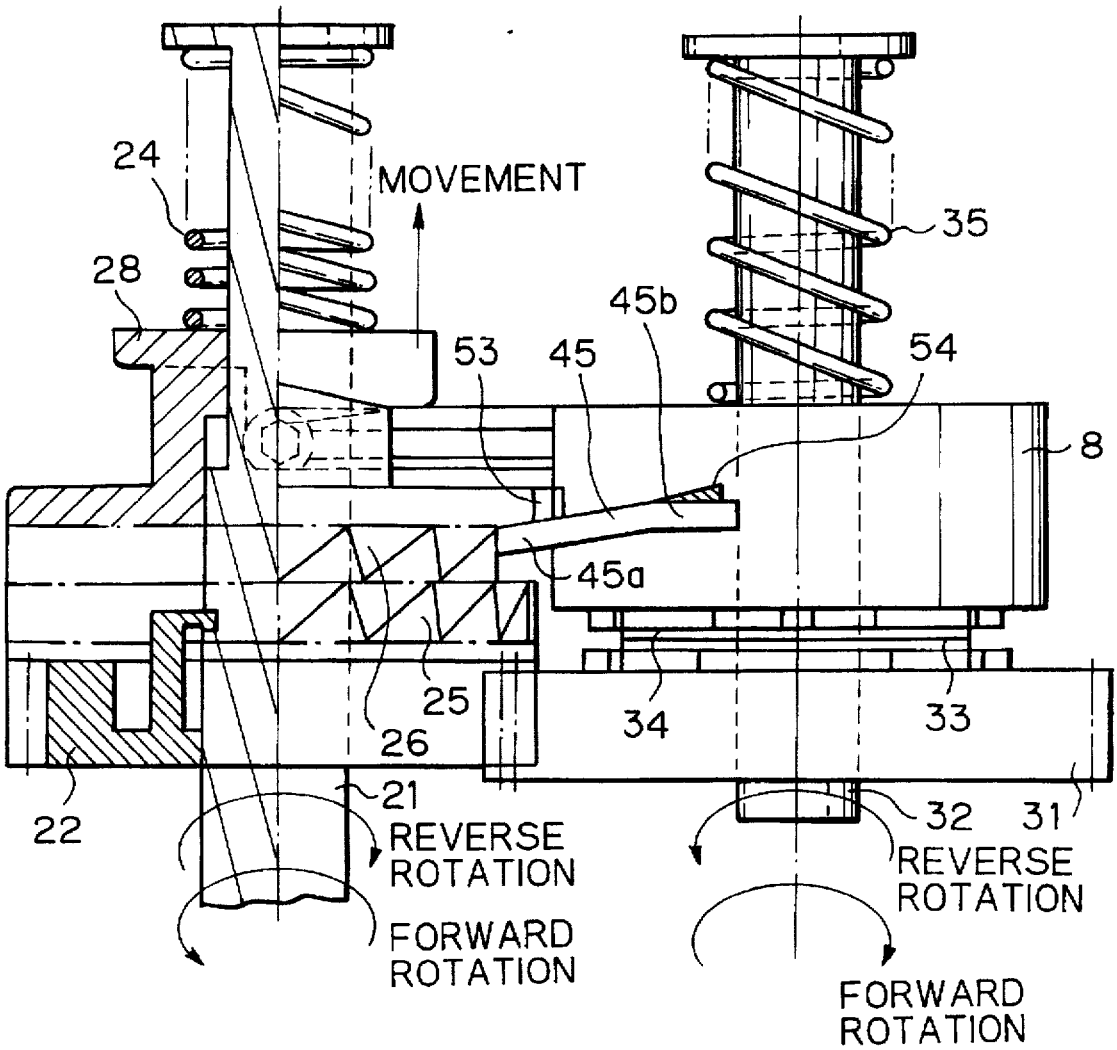
FIG. 16 is a view as seen in a different direction from FIG. 15.

FIGS. 15 and 16 show another alternative embodiment of the present invention also applied to an automatic paper feeder. In this embodiment, the same or similar constituents as or to the constituents of the fourth embodiment are designated by the same reference numerals, and a detailed description thereof will not be made in order to avoid redundancy.

As shown, an abutment 53 similar to the abutment 43 of the fourth embodiment and has the inclined surface **43*a* and end face 43*b* adjoining each other. A lug or stop member 54 is provided on the outer surface of the cam portion 45 with respect to the axial direction. The lug 54 has the leading end 45*a* smoothly contiguous with the surface of the cam portion 45, and the trailing end 45*b* substantially perpendicular to the surface of the cam portion 45. In this embodiment, the transmission gear 36 held in mesh with the switch gear 31 in the first embodiment is held in mesh with the clutch gear 22. A transmission gear 56 transmits the rotation of the motor 9 to the switch gear 31 via the clutch gear 22. The clutch gear 22 has a number of teeth Z1 greater than the number of teeth Z2 of the switch gear 31. This embodiment does not have the stop lever 41**.

In operation, when the motor 9 is rotated in the forward direction, the slide cam 23 is rotated in the same direction and releases the ratchet portions 25 and 26 from each other. Then, the motor 9 is reversed. The reversal of the motor 9 causes the cam lever 8 to move from a position indicated by a phantom line in FIG. 14 to a position indicated by a solid line. As a result, the pin **8*b* leaves the cam surface 27 of the slide cam 23, and the cam portion 45 starts contacting the abutment 43 of the cam 23 at its leading end 45*a*. Because the number of teeth Z1 of the clutch gear 22 is greater than the number of teeth Z2 of the switch gear 31, the gear 31 rotates more than the gear 22. Hence, before the cam lever 8 abuts against the stop 19, the abutment 53 contacts the leading end 45*a* of the cam portion 45, and then the end face 43*b* contacts the trailing end 45*b* over the lug 53 of the cam portion 45. Therefore, even if the motor 9 is continuously rotated in the reverse direction, the end face of the abutment is prevented from abutting against the lug 54 and rotating the slide cam 23 in the reverse direction. In addition, because the abutment 53 contacts the trailing end of the cam portion 45, the ratchet portions 35 and 36 are held in their spaced positions and prevent the slide cam 23** from rotating in the reverse direction due to the previously mentioned idle torque.

When the motor 9 and therefore the cam lever 8 is rotated in the forward direction, the lug 54 of the cam portion 45 presses the end face **53*b* of the abutment 53. The abutment 53 leaves the cam portion 45 while causing the slide cam to rotate in the forward direction. The slide cam 23 is moved toward the clutch gear 22 by the spring 24. Consequently, the ratchet portions 25 and 26 are brought into full contact and transmit the forward rotation of the motor 9 to the slide cam 23**.

This embodiment has the following advantages in addition to the advantages of the fourth embodiment. The reverse rotation of the slide cam 23 ascribable to an idle torque is stopped without resorting to the stop lever 41. This further simplifies the construction and reduces the cost. Further, because the force for rotating the cam lever 8 is transferred by way of the clutch gear 22, the number of teeth of the switch gear 31 is open to choice.

6th Embodiment

Figure 17:
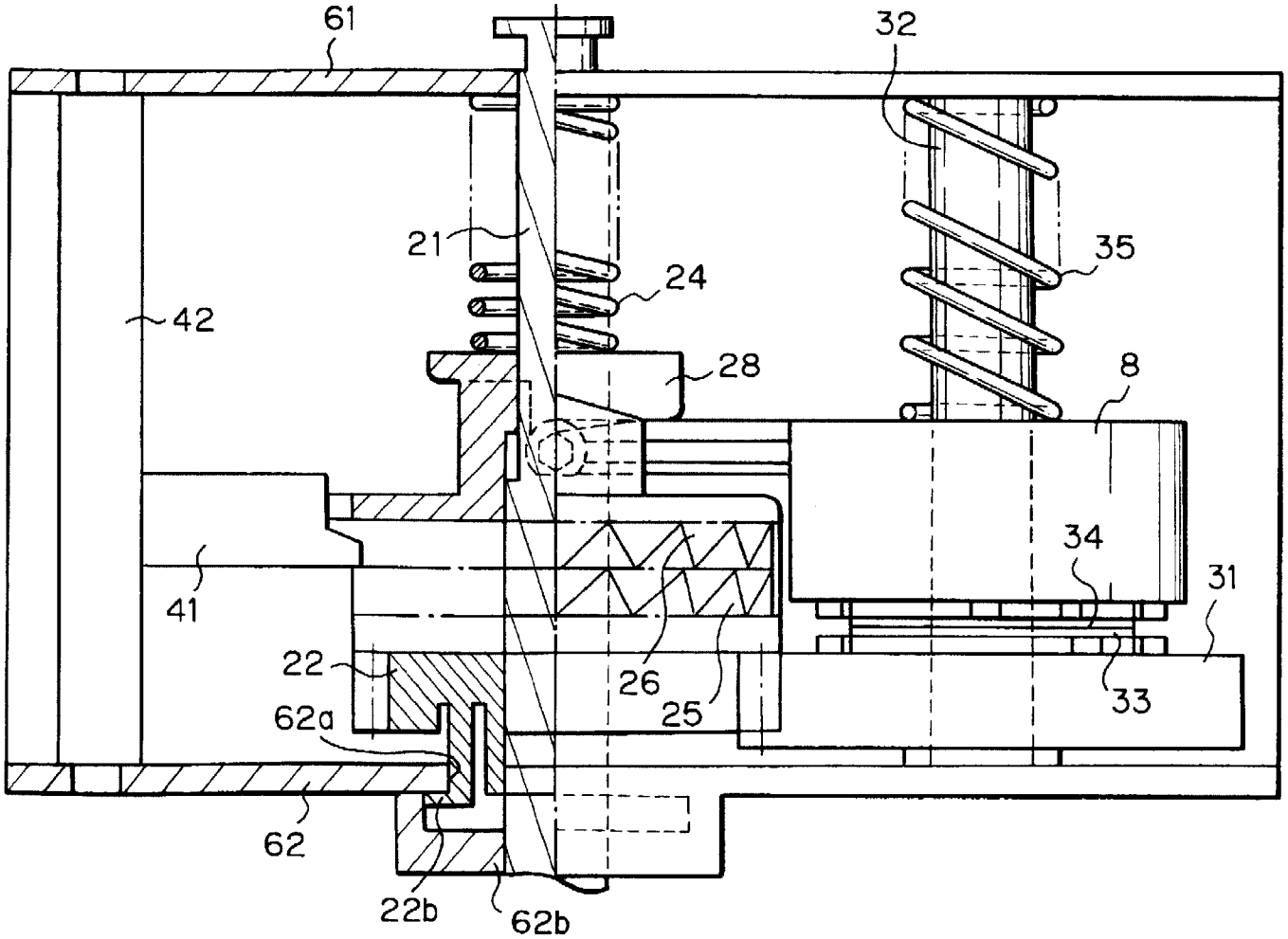
FIG. 17 is a view showing a sixth embodiment of the present invention.

FIG. 17 shows another alternative embodiment of the present invention also applied to an automatic paper feeder. In this embodiment, the same or similar constituents as or to the constituents of the third embodiment are designated by the same reference numerals, and a detailed description thereof will not be made in order to avoid redundancy.

As shown, a pair of frames 61 and 62 are affixed to an apparatus body. The stationary shaft 32 supporting the switch gear 31 and cam lever 8 is affixed to the frames 61 and 62. The clutch shaft 21 supporting the clutch gear 22 and slide cam 23 is journalled to the frames 61 and 62. The clutch mechanism is therefore constructed into a unit including the frames 61 and 62. The frame 62 is formed with a hole **62*a* greater in diameter than the clutch shaft 21. The clutch gear 22 has its stop pawl 22*b* received in the hole 62*a*, so that it is freely rotatable, but not movable in the axial direction. The clutch shaft 21 is rotatably supported by a bearing 62*b* covering the hole 62*a*. The support member 42 supporting the stop lever 41 is also rotatably supported by the frames 61 and 62**.

This embodiment has the following advantage in addition to the advantages of the third embodiment. In the third embodiment, the clutch gear 22 is supported with its stop pawl **22*a* received in the circumferential groove 21*b* of the clutch shaft 21, i.e., an independent positioning member. In this embodiment, because the frames 61 and 62 position the stationary shaft 32 and clutch gear 22, the switch gear 31, cam lever 8, clutch gar 22 and slide cam 23 are provided with the same reference in the axial direction. This allows the pin 8*b* of the cam lever 8 and the cam surface 27 of the slide cam 27** to be accurately positioned with ease.

7th Embodiment

Referring to FIGS. 18–26, another alternative embodiment of the present invention will be described. In this embodiment, the same or similar constituents as or to the constituents of the foregoing embodiments are designated by the same reference numerals, and a detailed description thereof will not be made in order to avoid redundancy.

Figure 18:
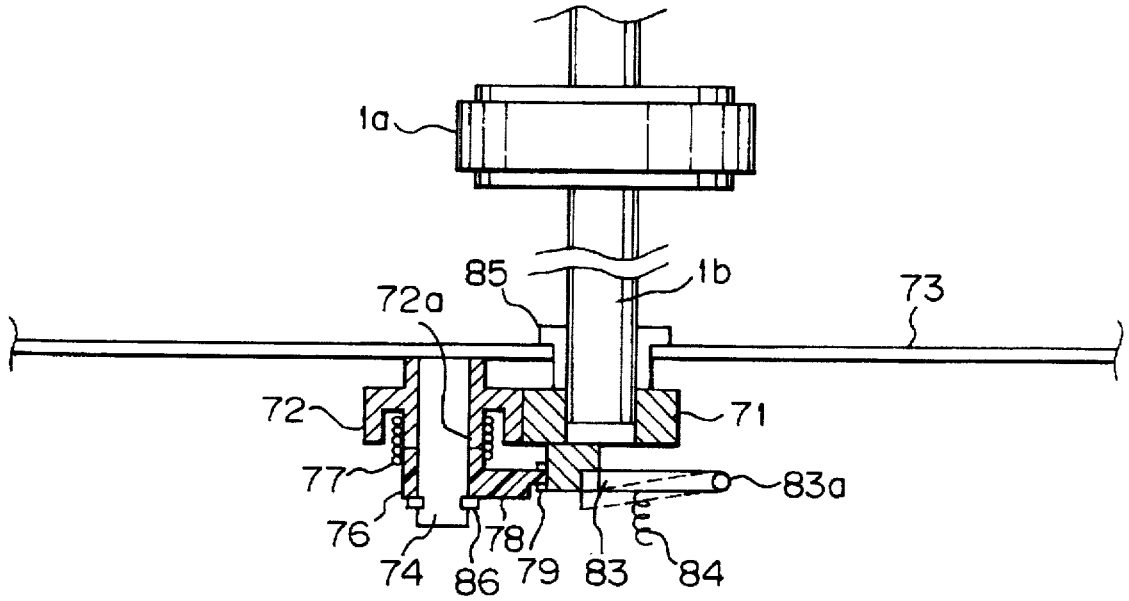
FIG. 18 is a partly sectional view showing a seventh embodiment of the present invention and as seen in the radial direction.
Figure 19:
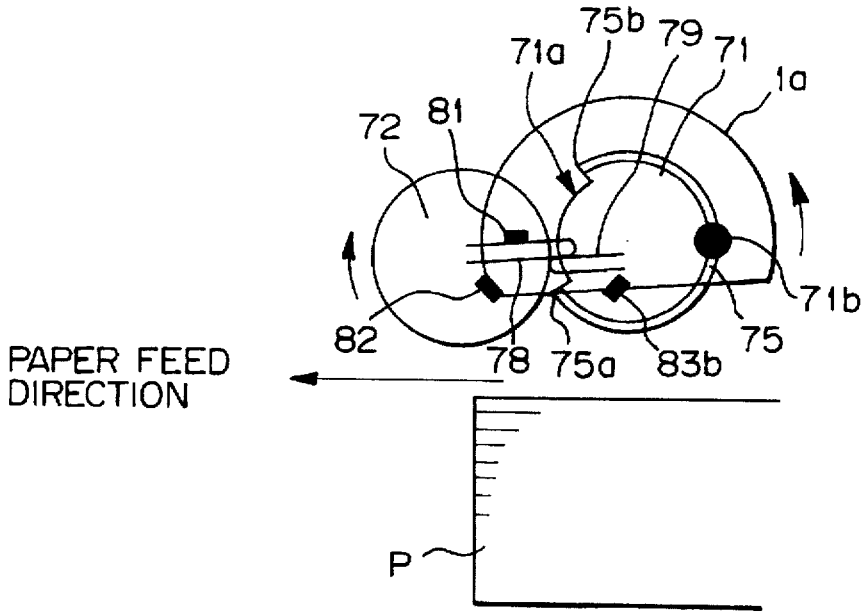
FIG. 19 is a view showing the seventh embodiment in its reference position and as seen in the axial direction.
Figure 20:
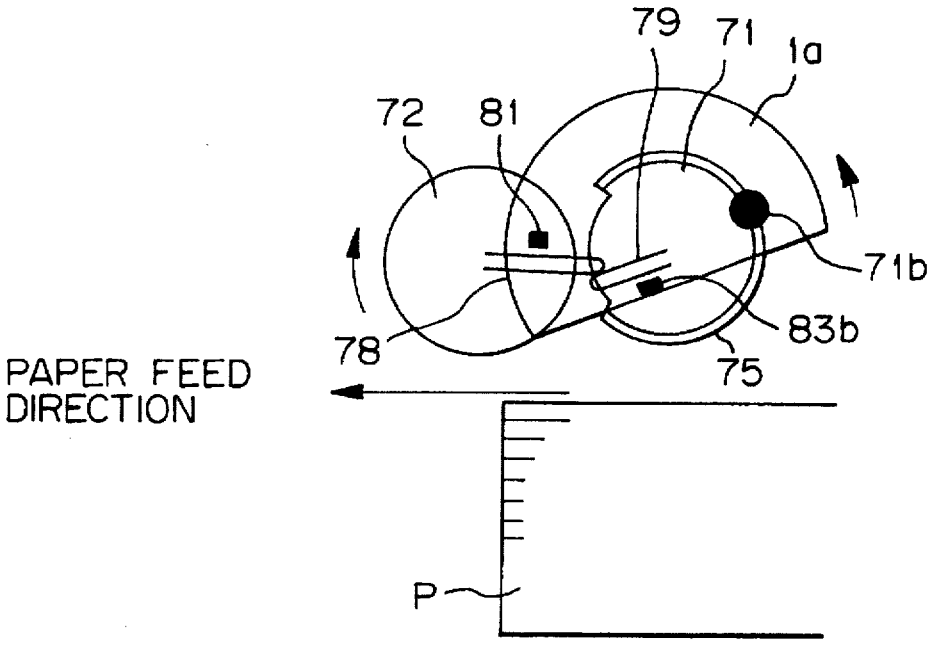
FIGS. 20–26 demonstrate a consecutive steps of operation of the seventh embodiment.
Figure 21:
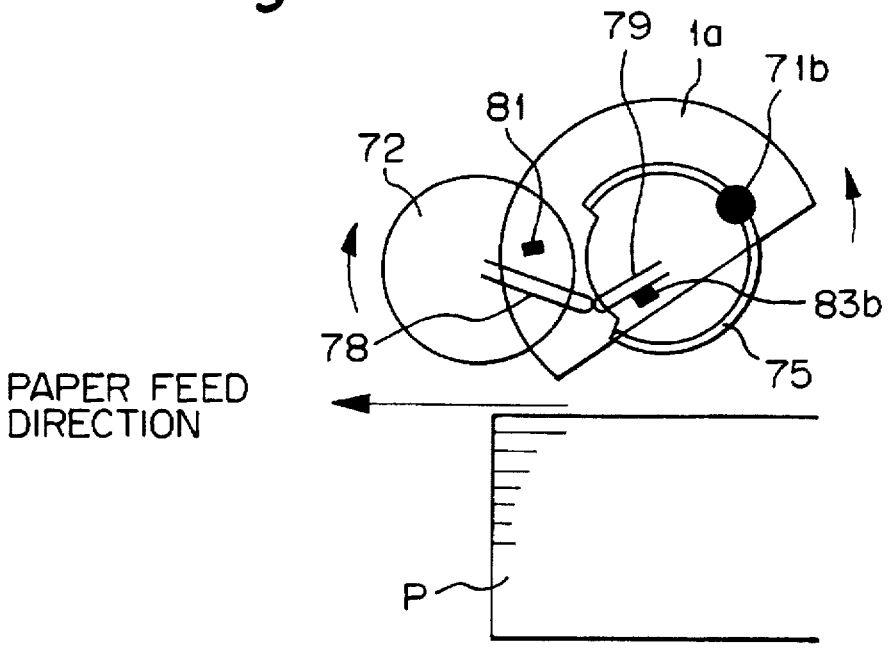
Figure 22:
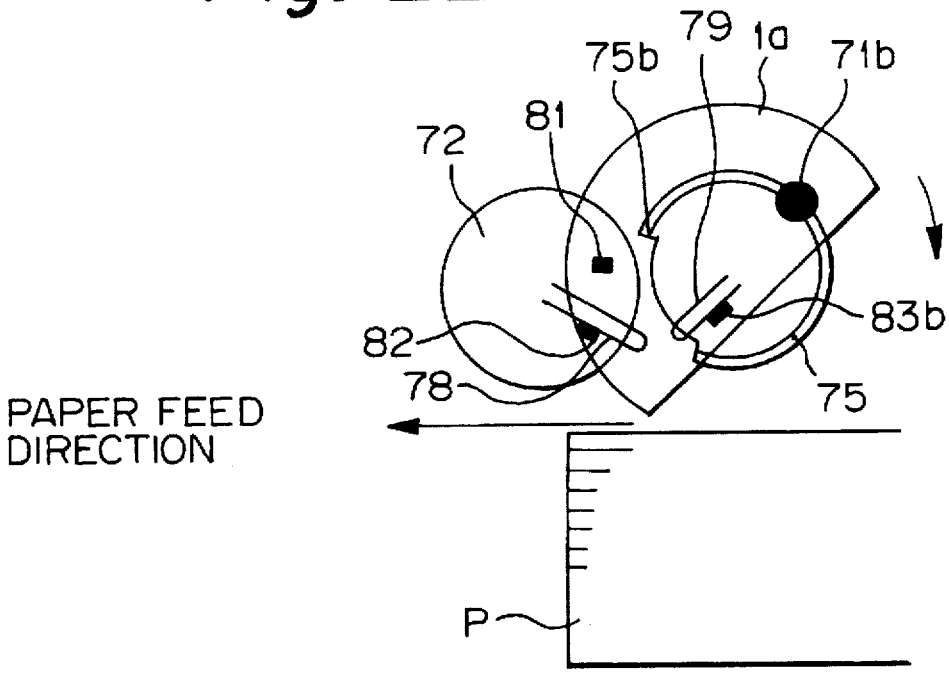

As shown in FIGS. 18 and 19, a notched gear 71 is affixed to one end of the roller shaft **1*b* supporting the roller portion 1*a* of the pick-up roller 1. A stationary shaft 74 is affixed to a side wall 73 of an apparatus body. An intermediate gear 72 is rotatably mounted on the shaft 74 at its hub portion 72*a*. The intermediate gear 72 is held in mesh with the notched gear 71 and constitutes a part of transmitting means for transmitting the output torque of the motor 9 (e.g. transmission gear train). The notched gear 71 has its tooth surface 75 partly notched to form a notched portion 71*a*. The notched portion 71*a* faces the intermediate gear 72 when the roller shaft 1*b* is brought to its reference position where the roller portion 1*a* does not contact a paper P. The tooth surface 75 has a start portion 75*a* and an end portion 75*b*. The start portion 75a starts meshing with the intermediate gear 72 before the roller portion 1a contacts the paper P. The end portion 75b is brought out of mesh with the gear 72 when the leading edge of the paper P reaches feeding means, not shown, located downstream of the pick-up roller in an intended direction of paper feed. A weight, for example, is mounted on the notched gear 71 at a position different from the tooth surface 75, so that the gear 71 has a center of gravity 71b symmetrical to the notched portion 71a** with respect to its axis.

A hub 76 is rotatably mounted on the stationary shaft 74 like the intermediate gear 72. A spring clutch 77 is affixed at one end to the hub portion 72a of the intermediate gear 72. The hub 76 is connected to the intermediate gear 72 by the spring clutch 77. When the gear 72 is rotated in the direction opposite to the direction paper feed (clockwise as viewed in FIG. 19), the spring clutch 77 fastens the hub 72a and hub 76 to couple them together. When the gear 72 is rotated in the direction of paper feed (counterclockwise as viewed in FIG. 19), the spring clutch 77 unfastens them and allows the hub 76 to rotate relative to the gear 72 while applying an idle torque to the hub 76. The spring clutch 77 may be affixed to the hub 76, if desired.

A lever 78 extends in the direction of a normal at one end of the hub 76. A lever 79 extends toward the notched portion 71a of the notched gear 71a substantially in parallel to the direction of a normal. When the levers 78 and 78 are both brought to a horizontal position, their ends abut against each other. When the lever 78 is rotated counterclockwise until it abuts against a stop 81, it is held in its horizontal position. In this condition, the lever 78 limits the clockwise rotation of the lever 79. When the lever 78 is rotated clockwise, it presses the lever 79 downward away therefrom and then abuts against a stop 82. When the lever 79 is rotated counterclockwise, the rotation is limited by the end 83b of a stop lever 83 rotatably supported by a fulcrum 83a. Further, when the lever 79 is released from the lever 78 and then rotated clockwise, it causes the stop lever 83 to rotate, moves over the end 83b of the lever 83, and then returns to the position where it buts against the lever 78. In this sense, the stop 78 plays the role of limiting/cancelling means while the stop lever 83 constitutes restricting means. To allow the lever 78 moving clockwise to move over the end 83b of the stop lever 83, one of the facing surfaces of the levers 78 and 83 may be formed with a slant; the lever 83 should only be restored by a spring 84. In FIG. 18, a bearing 85 rotatably supports the roller shaft 1b while a C-ring 86 prevents the hub 78 from slipping out of the shaft 74.

In operation, before the start of a paper feeding operation, the motor 9 is driven in the reverse direction in order to reverse the intermediate gear 72 (clockwise). As a result, the gear 72 and hub 76 are connected together by the spring clutch 77 and reversed from the position shown in FIG. 19. The reversal of the hub 76 causes the lever 78 to raise the lever 79 and thereby reverses the notched gear 71, as sown in FIGS. 20–22. After the end of the lever 78 has been released from the lever 79, the rotation of the lever 78 is limited by the stop 82. At the same time, the notched gear 71 begins to rotate forward (clockwise) due to a torque derived form the unique position of the center of gravity 71b. Although the reverse rotation of the notched gear 71 does not bring the roller 1a into contact with the paper P, further reverse rotation is limited by the end 83b of the stop lever 83 contacting the lever 79. This prevents the roller portion 1a from contacting the paper P and prevents the end 75b of the tooth surface 75 from meshing with (contacting) the gear 72.

Figure 23:
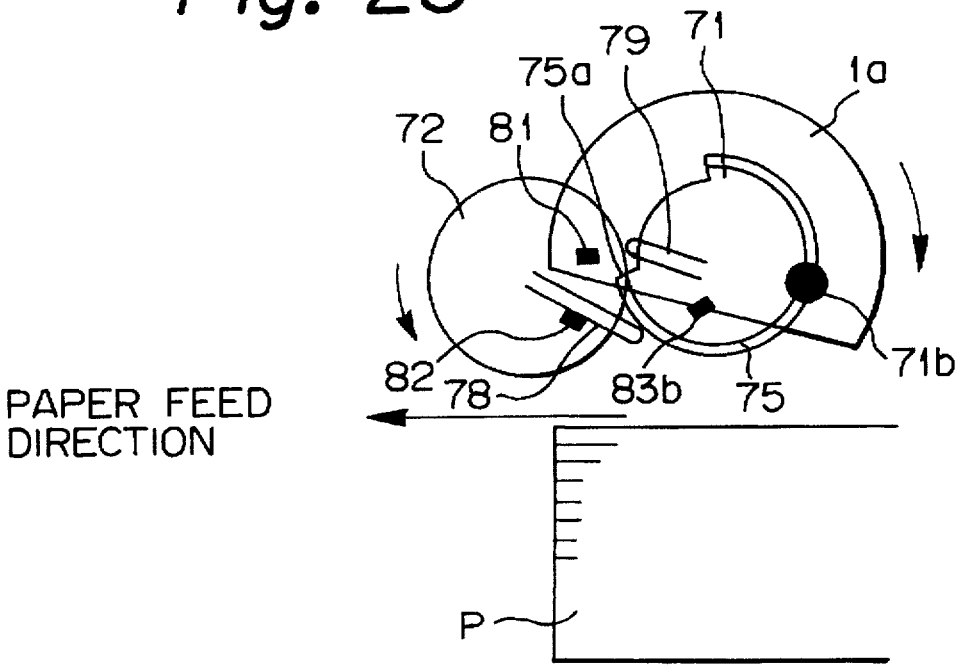
Figure 24:
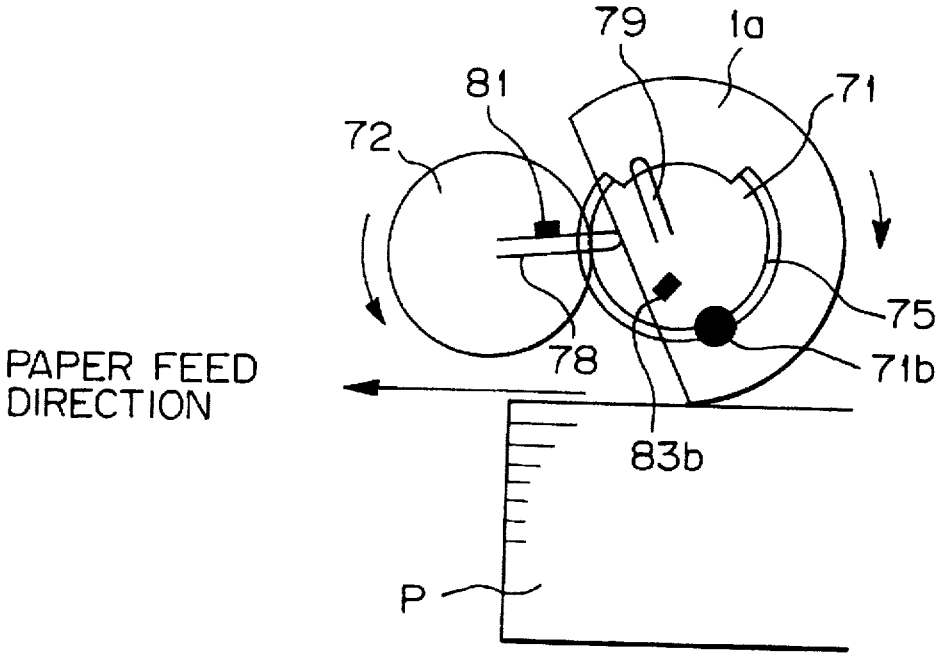

Subsequently, the notched gear 71 is rotated forward by a torque derived from the deviation of the center of gravity 71b. As a result, as shown in FIGS. 23 and 24, the start portion 75a of the tooth surface 75 contacts the gear 72. When the motor 9 is rotated forward, the tooth surface 75 of the gear 71 is brought into mesh with the gear 72. In this condition, the forward rotation of the motor 9 is transmitted to the roller portion 1a, causing it to start feeding the paper P. At this instant, the spring clutch 77 unfastens the hub 76. Hence, the lever 78 is held in abutment against the stop 81 due to an idle torque derived from the forward rotation of the gear 72.

Figure 25:
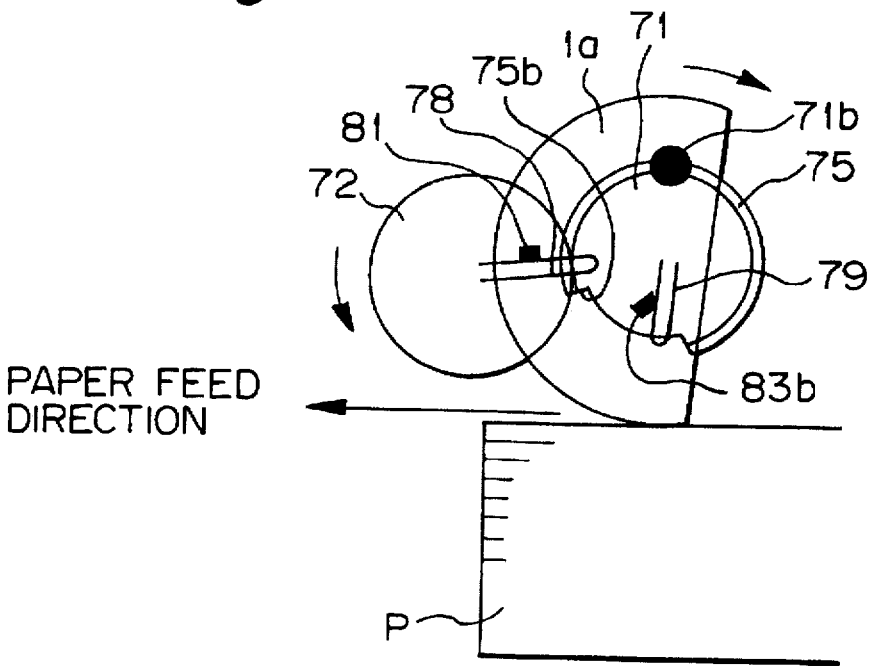
Figure 26:
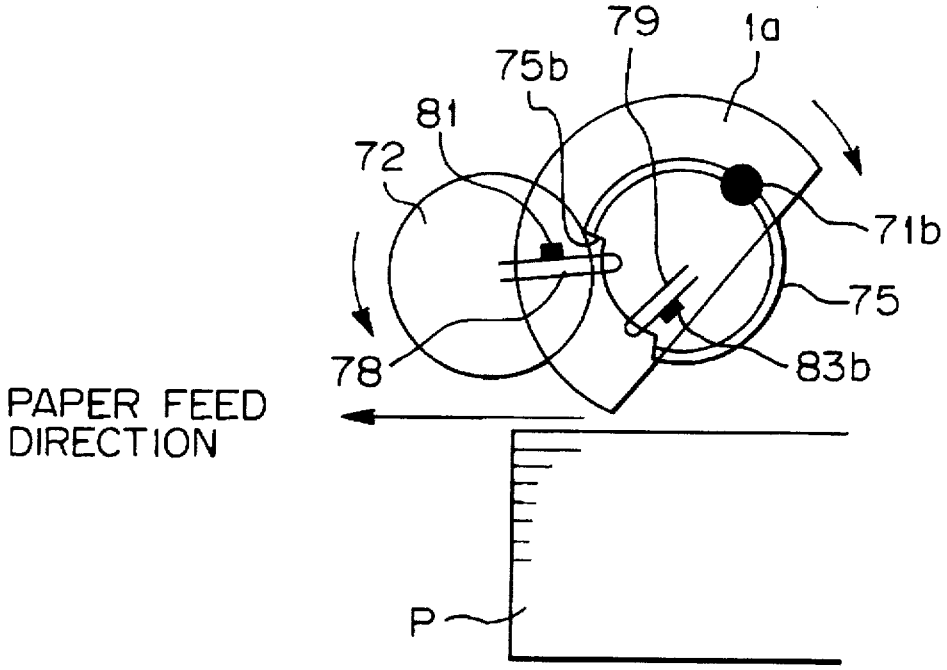

As shown in FIG. 25, when the leading edge of the paper P being fed by the roller portion 1a reaches the previously mentioned feeding means, the position where the gears 72 and 71 mesh with each other is brought to a position close to the end portion 75b of the tooth surface 75. Also, the center of gravity 71b of the gear 71 is displaced upward and displaced rightward (stand-by position side) with respect to the axis. As shown in FIG. 26, as soon as the roller portion 1a fully feeds the paper P, the end portion 75b of the tooth surface 75 leaves the gear 72. As a result, the gear 71 rotates forward due to the torque derived from the deviation of the center of gravity 71b. After the lever 79 has moved over the end 83b of the stop lever 83 while rotating the lever 83, the lever 79 is topped by the lever 78. Consequently, the roller 1a is located at its reference position or stand-by position shown in FIG. 19 and held there.

In the above stand-by condition, the rotation of the lever 79 is limited by the lever 78 and the end 83b of the stop lever 83. This limits the rotation of the notched gear 71 and thereby prevents the roller portion 1a from contacting the paper P.

As stated above, the notched gear 71 has its tooth surface 75 partly removed and has the center of gravity 71b at its deviated position. The lever 78 for rotating the gear 71 via the spring clutch 77 stops the lever 79. With such a simple configuration, it is possible to bring the notched portion 71a to the position corresponding to the intermediate gear 72. In this condition, the rotation of the gear 71 is limited and stopped, so that the roller shaft 1b is located at its reference position. When the limitation on the rotation of the gear 71 is cancelled, the gear 71 is rotated by a torque derived from the deviation of the center of gravity 71b until the tooth surface 75 meshes with the gear 72 from its start portion 75a. As a result, the output torque of the motor 9 is transmitted to the roller shaft 1b and causes it to start feeding the paper P. Before the roller portion 1a fully feeds the paper P, the center of gravity 71b is displaced to a position for exerting a torque on the gear 71. On the end of the paper feed, the end portion 75b of the tooth surface 75 is released from the gear 72, and the gear 71 is rotated forward due to the above torque. As a result, the lever 78 stops the lever 79 and therefore the rotation of the gear 71. The roller shaft 1b is restored to and held at its reference position.

The embodiment therefore causes the roller shaft 1b to make one rotation in response to the output torque of the motor 9 with a simple arrangement including only a small number of parts. This allows a plurality of drivelines to share the motor 9 at a minimum of cost. The torque to be applied to the notched gear 71 is achievable only if the center of gravity 71b is located at a particular position. Further, the spring clutch 77 should only move and stop the lever 78 via the hub 76 and is not supported by another member. This obviates severe tolerance requirements and prevents the capacity of the motor 9 from being increased due to a wasteful idle torque, thereby reducing the cost.

The tooth surface 75 of the gear 71 should only be notched such that it starts meshing with the gear 72 before the roller portion 1*a* contacts the paper P, and leaves it after the leading edge of the paper P has reached the feeding means. The gear 71 is therefore easy to produce and promotes reliable paper feed.

When the roller 1*b* is held in its reference position, the forward rotation of the gear 71 due to the torque ascribable to the center of gravity 71*b* is limited by the stop 78. Even if the gear 71 in such a position rotates in the reverse direction, the rotation is limited by the end 83*b* of the stop lever 83 before the roller portion 1*a* contacts the paper P. This prevents the roller shaft 1*b* from being displaced from the reference position in the stand-by condition. The embodiment therefore obviates an occurrence that, for example, the paper P jammed a path and being pulled out causes the roller 1*a* to rotate and prevents it from resuming paper feed in the expected manner.

8th Embodiment

Figure 27:
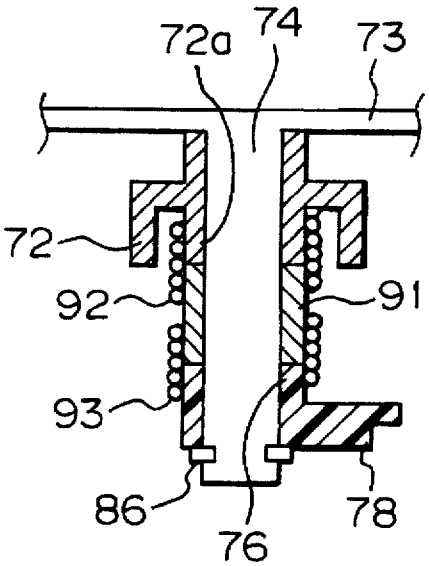
FIG. 27 is a partly sectional enlarged view of an eighth embodiment of the present invention as seen in the radial direction.

FIG. 27 shows another alternative embodiment of the present invention also applied to an automatic paper feeder. This embodiment is similar to the seventh embodiment except for the following.

As shown, a relay hub 91 is interposed between the hub portion 72*a* of the intermediate gear 72 and the hub 76 and rotatably supported by the stationary shaft 74. The relay hub 91 is connected to the hub portion 72*a* by a spring clutch 92 and connected to the hub 76 by a spring clutch 93. The spring clutches 92 and 93 have turns opposite in direction to each other. During the forward rotation of the gear 72, after the lever 78 has abutted against the stop 81, one of the spring clutches 92 and 93 idles and thereby prevents the driveline from locking. During the reverse rotation of the gear 72, after the lever 78 has abutted against the stop 88, the other of the spring clutches 92 and 93 idles for the same purpose.

This embodiment has the following advantage in addition to the advantages of the seventh embodiment. The lever 78 of the hub 76 is connected to the hub 72*a* of the gear 72 via the relay hub 91 and spring clutches 92 and 93. In this condition, when the lever 78 is topped by the stop 82 during the reverse rotation of the gear 72, the other of the spring clutches 92 and 93 idles and generates an idle torque. This allows the motor 9 to be continuously rotated in the reverse direction and allows it to be shared by a plurality of drivelines without regard to the drive direction.

In a modification of this embodiment, although not shown specifically, one of the spring clutches 92 and 93 caused to idle by the stop 81 during the forward rotation of the gear 72 is provided with a smaller limit value than the other so as to generate an idle torque only great enough to maintain the position of the lever 78. Specifically, while an idle torque great enough for the lever 78 to lower the lever 79 of the gear 71 is necessary during the reverse rotation of the gear 72, it should only be great enough to maintain the position of the lever 78 during the forward rotation, i.e., at the time of paper feed. With this modification, it is possible to prevent the capacity of the motor 9 from being wastefully increased due to a load acting on the motor 9 during the course of paper feed, and therefore to reduce the cost.

9th Embodiment

Figure 28:
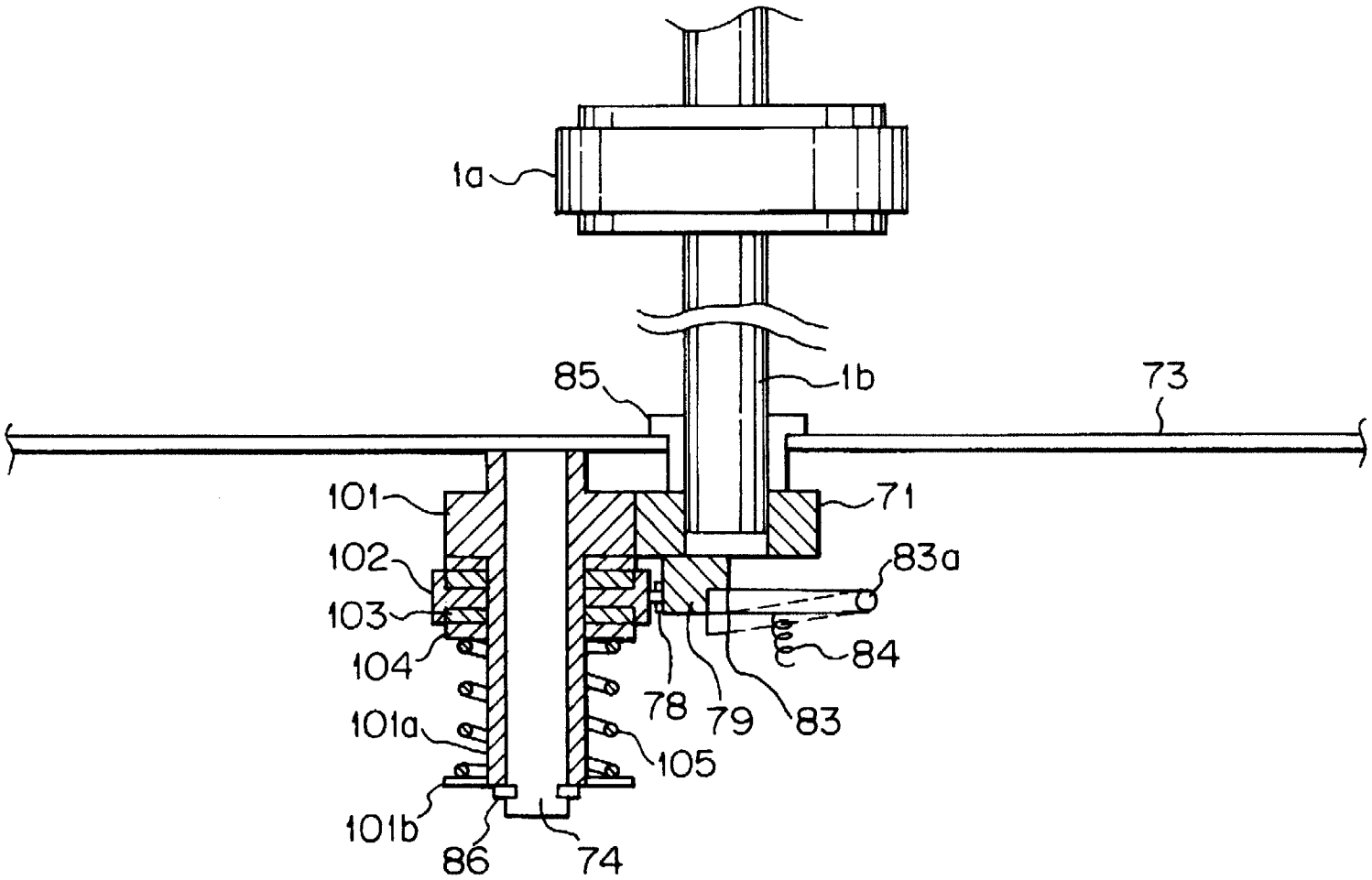
FIG. 28 is a partly sectional enlarged view of a ninth embodiment of the present invention as seen in the radial direction.

FIG. 28 shows yet another alternative embodiment of the present invention also applied to an automatic paper feeder. This embodiment is similar to the eighth embodiment except for the following.

As shown, an intermediate gear 101 is held in mesh with the notched gear 71 and constitutes a part of the drive transmitting means. The gear 101 is formed integrally with a hollow rotary shaft 101*a* in which a stationary shaft 74 is received. The gear 101 includes a flange 101*b*. A disk 102 has the lever 78 and is rotatably supported by the shaft 101*a*. Friction plates 103 having a preselected frictional force are buried in both ends of the disk 102 with respect to the axial direction. A spring or biasing means 105 is supported by the flange 101*b* of the shaft 101*a*. The spring 105 constantly biases the disk 102 at the side opposite to the gear 101 such that disks 104 having a preselected frictional force are each pressed against the associated friction plates 103. These constituents constitute a torque limiter for generating an idle torque based on the frictional forces. The disks 104 are affixed to the gear 101 and spring 105.

This embodiment is comparable with the seventh and eight embodiments as to the operation and advantages. Specifically, because the torque limiter is based on the friction acting between the friction plates 103 of the disk 102 and the disk 104, the motor 9 can be continuously driven in the forward or reverse direction, as needed. The other end of the spring 105 is seated on the flange 101*b* of the gear 101. Therefore, even if the spring 105 and flange 101*b* slip on each other, the resulting idle torque is not wasted. This makes it needless to increase the biasing force of the spring 105; otherwise, the load to act on the motor 9 would be increased. Consequently, the motor 9 can be shared by a plurality of drivelines without regard to the drive direction, so that the cost is reduced.

While the gear 101, shaft 101*a* and flange 101*b* have been shown and described as being implemented as a single member, they may be formed independently of each other and affixed together.

10th Embodiment

Figure 29:
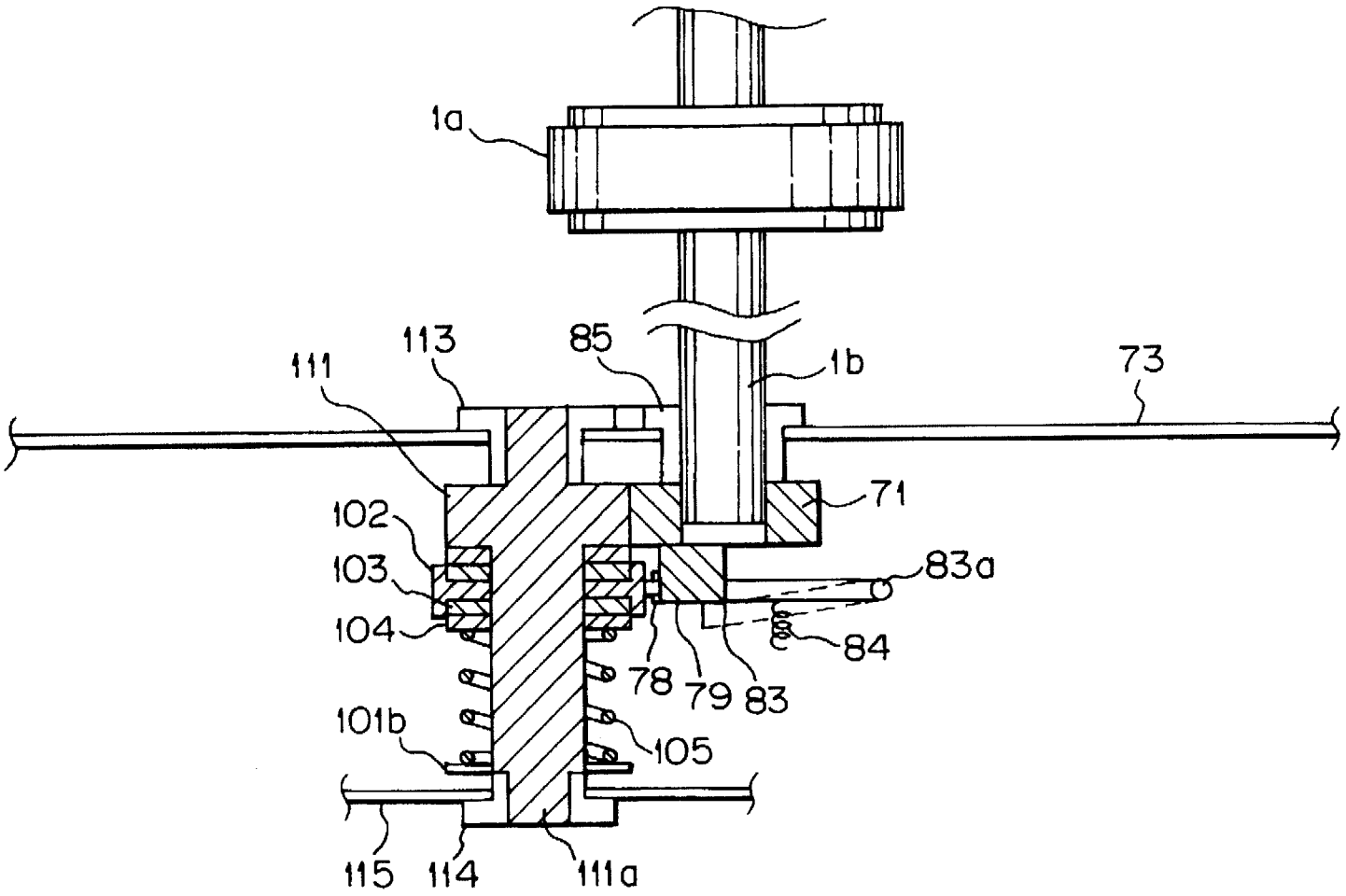
FIG. 29 is a partly sectional enlarged view of a tenth embodiment of the present invention as seen in the radial direction.
Figure 30:
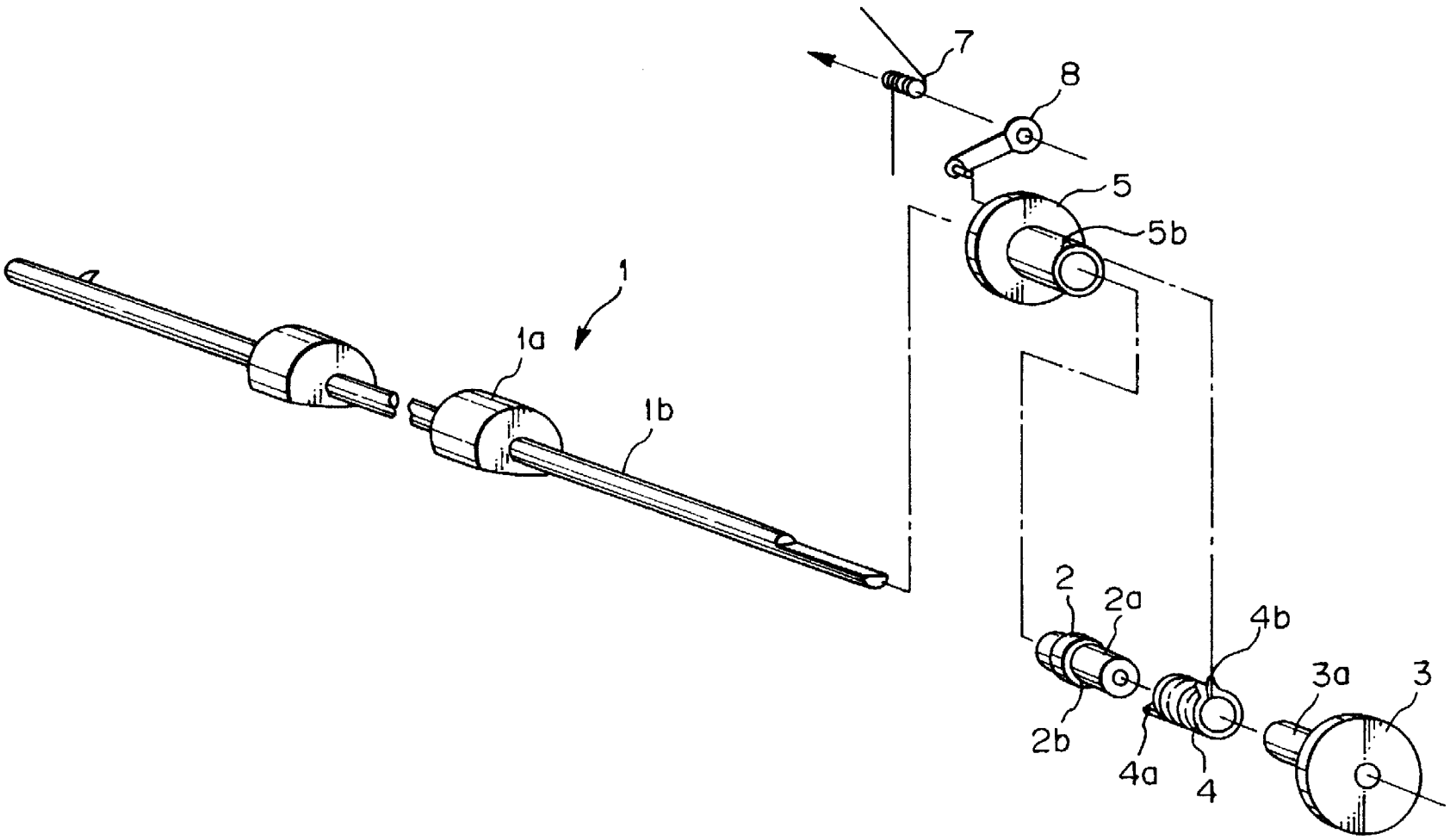
Fig. 30 PRIOR ART
FIG. 30 is an exploded perspective view showing a conventional clutch mechanism.
Figure 31:
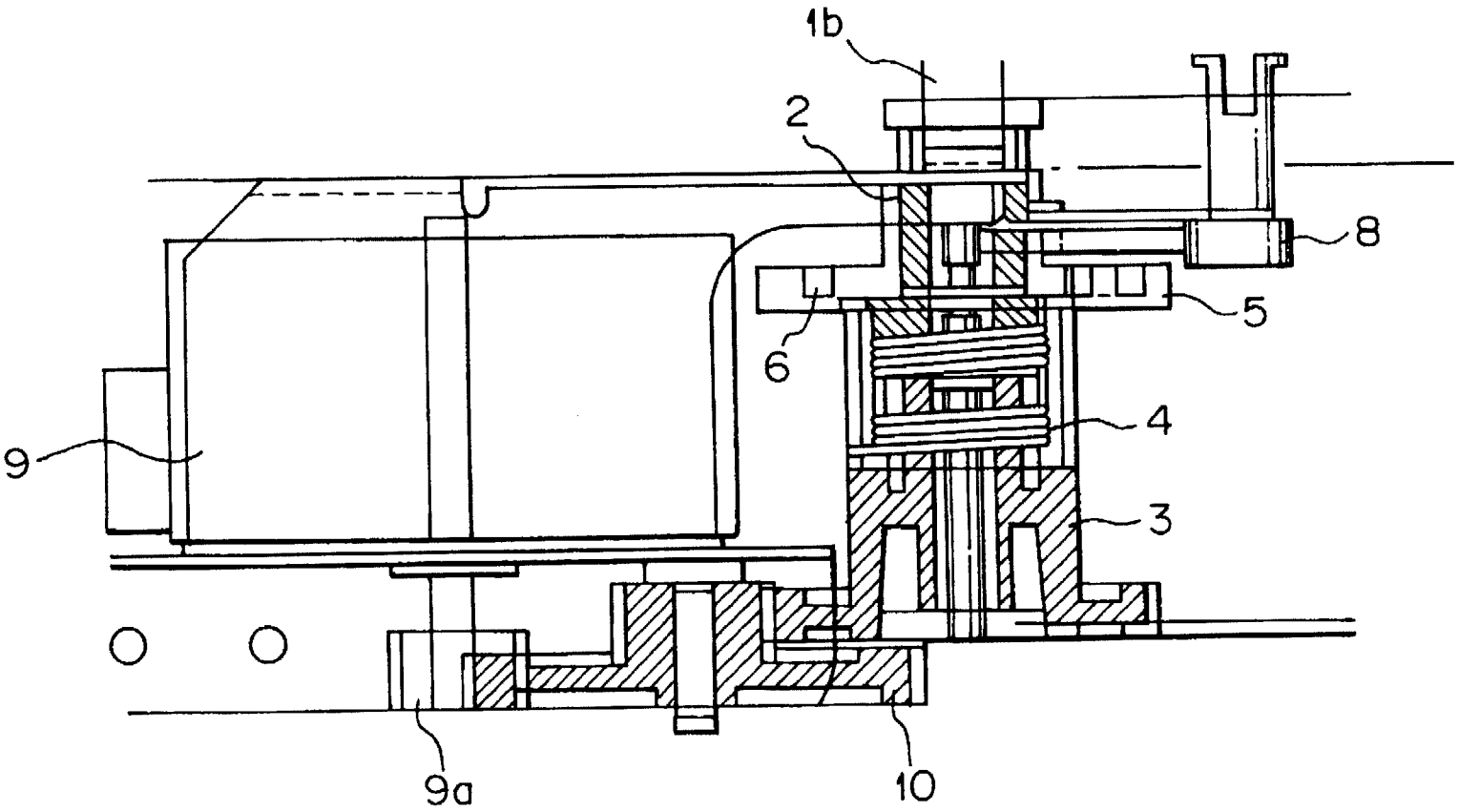
Fig. 31 PRIOR ART
FIG. 31 is a partly sectional view of the conventional clutch mechanism shown in FIG. 30.

FIG. 29 shows a further alternative embodiment of the present invention also applied to an automatic paper feeder. This embodiment is similar to the ninth embodiment except for the following.

As shown, an intermediate gear 111 is held in mesh with the notched gear 71 and constitutes a part of the drive transmitting means. The gear 111 is formed integrally with a cylindrical shaft 111*a*. The flange 101*b* is formed integrally with one end portion of the gear 111. The gear 111 has its shaft 111*a* rotatably supported by the side wall 73 and another side wall 115 via bearings 113 and 114, respectively.

In the illustrative embodiment, the shaft 111*a* for causing the gear 111 to rotate is rotatably supported by the bearings 113 and 114. This successfully reduces the resistance (load) to the rotation of the gear 111 and thereby further reduces the wasteful load to act on the motor 9. The embodiment, of course, achieves the advantages described in relation to the ninth embodiment in addition to the above advantage.

In summary, it will be seen that the present invention provides a clutch mechanism having various unprecedented advantages, as enumerated below.

(1) A force output from a drive source for rotating a transmission gear in a preselected direction is cut off after a rotary member has been rotated to a preselected position in a preselected direction, thereby stopping the rotary member. A force output from the drive source for rotating the transmission gear in the reverse direction is cut off to prevent the rotary member from rotating. When the transmission gear is rotated in the reverse direction, a slide member is released from a cam surface included in uncoupling means. This allows the drive source to be continuously driven in the forward or reverse direction, as desired. The drive source therefore can be shared by a driveline for rotating a rotary shaft to a preselected angular position in a preselected position and other drivelines, so that the cost is reduced. Because the clutch mechanism does not include any complicated structure, it needs only a minimum of number of parts and is therefore small size and simple. The clutch mechanism is reliable because the slide member should only be moved toward and away from the cam surface.

(2) The output force of the drive source is transmitted via a torque limiter based on friction. Hence, the slide member can abut against the cam surface without the drive source being deenergized. This implements the transmission of the output force of the drive source which is reversible, and thereby allows the slide member to be moved by the force of the drive source adapted to rotate the transmission gear. As a result, the construction is further simplified, and the cost is further reduced.

(3) Ratchet portions are provided on the faces of the transmission gear and rotary member facing each other. The ratchet portions have their contact surfaces coupled or uncoupled in accordance with the relative direction of rotation of the transmission gear and rotary member. This makes it needless to use an inexpensive spring clutch and allows the drive source to be continuously driven in the forward or reverses direction with a simple construction. Further, the cost is reduced.

(4) When the rotary member idles, an abutment is abutted against a stop member in order to stop the idling. When the rotary member is connected to the transmission gear and rotated thereby, the abutment does not abut against the stop member. Hence, the rotary member rotating based on an idle torque can be stopped while the rotation of the rotary member connected to the transmission gear is not obstructed. This allows the rotary shaft to be positioned and enhances reliability.

(5) When the transmission gear is rotated in the direction opposite to the preselected direction, the ratchet portions are held in their released positions. Therefore, during the above rotation of the transmission gear, the ratchet portion of the gear does not contact the ratchet portion of the stationary member. This reduces the idle torque to act on the stationary member and reduces noise when the ratchet portions contact each other in the event of reverse rotation of the transmission gear.

(6) After the slide member has reached a preselected position while tolerating the machining and assembling errors of parts, the ratchet portions are released from each other. Hence, the rotary member can be surely stopped at a preselected range, enhancing reliability.

(7) A notched gear has its tooth surface partly removed and has its rotation limited in accordance with the drive direction of the drive source in order to locate the rotary shaft at the reference position. When the limitation on the rotation is cancelled, the notched gear is rotated by a torque applied in the forward direction until it meshes with an intermediate gear. As a result, the drive transmission from the drive source to the rotary shaft is set up. Subsequently, when the rotary shaft approaches the reference position, the notched gear is released from the intermediate gear at its notched portion. This interrupts the drive transmission and limits the further rotation to thereby stop the rotary shaft at the reference position. Hence one rotation of the rotary shaft in the forward direction and the stop thereof at the reference position can be implemented by a simple configuration. The clutch mechanism is therefore small size and needs a minimum number of parts. The operation of the mechanism is reliable because the drive transmission is set up and interrupted only by the notched tooth surface of the notched gar.

(8) The drive transmission to means for limiting the rotation of the notched gear and cancelling the limitation is effected by friction derived from a friction plate biased against the intermediate gear. The drive source can therefore bed continuously driven in the forward or reverse direction, as needed. Because the end of biasing means opposite to the intermediate gear is supported by a member rotatable integrally, all the idle torque can be transferred to the above limiting/cancelling means. This allows the drive source to be shared by a plurality of drivelines and reduces wasteful loads to act on the drive source, thereby reducing the cost of an apparatus body on which the clutch mechanism is mounted.

(9) Because a shaft with which the intermediate gear is rotatable integrally is rotatably supported by bearings, loads to act between the clutch mechanism and the outside can be reduced. This further reduces wasteful loads to act on the drive source.

(10) The notched gear is supported by the rotary shaft of a pick-up member and mounted on an automatic paper feeder. Assume that the position where the pick-up member does not contact a paper stack. Then, the tooth surface of the notched gear is notched such that the gear meshes with the intermediate gear before the pick-up member starts feeding a paper, and then leaves it after the leading edge of the paper has reached feeding means located downstream of the pick-up member in an intended direction of paper feed. Hence, the paper feeder can surely feed the paper. This allows the drive source of the paper feeder to be shared by other drivelines, effects paper feed with a simple construction, and enhances reliability.

(11) The center of gravity of the notched gear mounted on the shaft of the pick-up member is deviated from the axis such that the application of the torque begins after the pick-up member has fully fed the paper. This allows the torque to be applied to the notched gear with a simple arrangement and thereby reduces the cost.

(12) Even if the notched gear rotates in the reverse direction from the position where the rotary shaft is located at its reference position, the rotation is limited before the pick-up member contacts the paper. This prevents the notched gear from rotating in the forward or reverse direction in a stand-by condition wherein the rotary shaft is located at the reference position. As a result, the reliable operation of the mechanism is enhanced.

(13) The torque limiter for transmitting the output torque of the drive source to the limiting/cancelling means is operable without regard to the drive direction of the drive source. The limit value for the force of the drive source for rotating the pick-up member in the direction of paper feed is selected to be smaller than the other limit value. Therefore, the drive source can be continuously rotated in the forward or reverse direction, as needed. In addition, the idle torque of the torque limiter is reduced which acts on the drive source as a load during paper feed. This allows the drive source of the paper feeder to be shared by other drivelines, reduces the wasteful loads to act on the drive source, and reduces the cost of the paper feeder.

Various modifications will become possible for those skilled in the art after receiving the teachings of the present disclosure without departing from the scope thereof.

What is claimed is:

1. A clutch mechanism for rotating a rotary shaft by transmitting a drive force output from a drive source to the rotary shaft, said clutch mechanism comprising:

a transmission gear rotatable on receiving the drive force;

a rotary member mounted on the rotary shaft and unrotatable relative to the rotary shaft;

coupling/uncoupling means for selectively connecting or disconnecting said transmission gear from a stationary member in accordance with a direction of rotation of said transmission gear to thereby set up or interrupt delivery of the drive force to said rotary member;

cancelling means provided with a cam surface having a preselected configuration and with which a slide member slidingly contacts, and for cancelling, when a slide surface rotating in accordance with a rotation of said rotary member reaches a predetermined position on said cam surface, a connection between said transmission gear and said rotary member; and moving means for selectively moving said slide member in a forward or a reverse direction in accordance with the direction of rotation of said transmission gear to thereby move said slide member toward or away from said cam surface of said cancelling means.

2. A clutch mechanism as claimed in claim 1, further comprising a torque limiter interposed between said moving means and said drive source and using a preselected frictional force.

3. A clutch mechanism as claimed in claim 1, wherein said coupling/uncoupling means comprises:

biasing means for constantly biasing said transmission gear and said rotary member toward each other; and a first and a second ratchet portion respectively formed on an end of said transmission gear and an end of said rotary member facing each other, and for selectively coupling or uncoupling a contact surface of said transmission gear and a contact surface of said rotary member in accordance with a relative direction of rotation of said transmission gear and said rotary member;

wherein said cancelling means selectively releases said first and second ratchet portions from each other in accordance with a position of said slide member sliding on said cam surface to thereby cancel the connection between said transmission gear and said rotary member.

4. A clutch mechanism as claimed in claim 3, further comprising a stop member slidably contacting a peripheral face of said rotary member, and an abutment formed at a preselected position of said peripheral face and capable of abutting against said stop member when said stationary member idles.

5. A clutch mechanism as claimed in claim 3, further comprising space maintaining means for maintaining, when said transmission gear is rotated in a reverse direction opposite to a preselected position, said first and second ratchet portions in spaced positions set up by said cancelling means when said transmission gear was rotated in said preselected direction.

6. A clutch mechanism as claimed in claim 3, wherein said cam surface of said cancelling means comprises:

a first slide surface for preventing said first and second ratchet portions from being released until said slide member reaches a predetermined position, tolerating machining and assembling errors; and a second slide surface for releasing said first and second ratchet portions after said slide member has reached said preselected position, while tolerating the machining and assembling errors.

7. A clutch mechanism as claimed in claim 1, further comprising a stop member slidably contacting a peripheral face of said rotary member, and an abutment formed at a preselected position of said peripheral face and capable of abutting against said stop member when said stationary member idles.

8. A clutch mechanism for rotating a rotary shaft by transmitting a drive force output from a drive source to the rotary shaft, said clutch mechanism comprising:

a notched gear supported by the rotary shaft, and unrotatable relative to the rotary shaft, and meshing with an intermediate gear driven by said drive source, wherein a part of a tooth surface of said notched gear corresponding to said intermediate gear when the rotary shaft is located at a preselected reference position is removed;

torque applying means for applying a torque in a forward direction to said notched gear; and limiting/cancelling means receiving the drive force of the drive source via a torque limiter, and for limiting, when the rotary shaft is located at the reference position, a rotation of said notched gear against the torque applied by said torque applying means, or cancelling a limitation on the rotation of said notched gear in accordance with a drive direction of the drive source.

9. A clutch mechanism as claimed in claim 8, wherein said torque limiter comprises:

a friction plate supported coaxially with said intermediate gear, and rotatable relative to said intermediate gear, and for generating a preselected frictional force at least between said friction plate and said intermediate gear; and biasing means for biasing said friction plate toward said intermediate gear, wherein said biasing means has a side thereof opposite to said intermediate gear supported by a member rotatable integrally with said intermediate gear.

10. A clutch mechanism as claimed in claim 9, wherein said intermediate gear is rotatable integrally with a shaft, and wherein said shaft is rotatably supported by bearings.

11. A clutch mechanism as claimed in claim 8, wherein said clutch mechanism is mounted on a paper feeder including a pick-up member having a semicircular cross-section and for feeding a paper to a downstream side in an intended direction of paper feed by one rotation, and wherein said notched gear is supported by a rotary shaft of the pick-up member and notched such that said notched gear meshes with said intermediate gear before the pick-up member contacts the paper, and leaves said intermediate gear after a leading edge of the paper has reached paper feeding means located downstream of the pick-up member in the intended direction paper feed.

12. A clutch mechanism as claimed in claim 11, wherein said torque applying means has a center of gravity displaced from an axis of said notched gear such that said torque applying means applies the torque in the forward direction to said notched gear after the pick-up member has fully fed the paper.

13. A clutch mechanism as claimed in claim 11, further comprising limiting means for limiting, before the pick-up member contacts the paper, a rotation of said notched gear in a reverse direction from a position thereof at which the rotary shaft is located at the reference position.

14. A clutch mechanism as claimed in claim 11, wherein said torque limiter is operable in response to either one of a forward and a reverse drive of the drive source, and has a smaller limit value for the drive force causing said pick-up member in the intended direction of paper feed than for the other drive force.

* * * * *